US006913339B2

(12) United States Patent
Uchida et al.

(10) Patent No.: US 6,913,339 B2
(45) Date of Patent: Jul. 5, 2005

(54) HEAD RECOVERY DEVICE, HEAD RECOVERY METHOD AND INK JET RECORDING APPARATUS

(75) Inventors: Haruo Uchida, Kanagawa (JP); Isao Ebisawa, Tokyo (JP); Yasuyuki Hirai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/968,792

(22) Filed: Oct. 3, 2001

(65) Prior Publication Data

US 2004/0041876 A1 Mar. 4, 2004

(30) Foreign Application Priority Data

Oct. 4, 2000 (JP) ..... 2000-304940
Sep. 5, 2001 (JP) ..... 2001-268584

(51) Int. Cl.[7] ..... B41J 2/165
(52) U.S. Cl. ..... 347/29; 347/35
(58) Field of Search ..... 347/22, 24, 29, 347/30, 31, 32, 33, 35; 106/31.27, 31.28, 31.6

(56) References Cited

U.S. PATENT DOCUMENTS

| | | | | |
|---|---|---|---|---|
| 5,266,974 A | | 11/1993 | Koitabashi et al. | 346/140 R |
| 5,517,219 A | | 5/1996 | Uchida | 347/24 |
| 5,644,347 A | | 7/1997 | Schwiebert et al. | 347/33 |
| 5,798,775 A | | 8/1998 | Takahashi et al. | 347/33 |
| 5,883,647 A | | 3/1999 | Uchida | 347/29 |
| 6,084,616 A | * | 7/2000 | Nakata et al. | 347/65 |
| 6,193,351 B1 | | 2/2001 | Yaegashi et al. | 347/23 |
| 6,312,089 B1 | * | 11/2001 | Imai | 347/24 |
| 6,447,095 B1 | | 9/2002 | Kanda et al. | |
| 6,663,218 B2 | * | 12/2003 | Uchida | 347/29 |

FOREIGN PATENT DOCUMENTS

| | | |
|---|---|---|
| EP | 0 844 094 A2 * | 5/1998 |
| EP | 1 002 648 A | 5/2000 |
| EP | 1 002 648 | 5/2000 |
| EP | 1 243 420 A | 9/2002 |
| JP | 2-102058 | 4/1990 |
| JP | 4-339665 | 11/1992 |
| JP | 6-191061 | 7/1994 |
| JP | 7-164643 | 6/1995 |
| JP | 8-324001 | 12/1996 |
| JP | 9-85964 | 3/1997 |
| JP | 11-58776 | 3/1999 |
| JP | 2001-1534 | 1/2001 |
| WO | WO 01/43974 | 6/2001 |

OTHER PUBLICATIONS

U.S. Appl. No. 08/442,769, filed May 17, 1995 patented 6,447,095.

U.S. Appl. No. 09/965,836, filed Oct. 1, 2001 patented 6,663,218.

Official Letter, dated Feb. 26, 2003, in EP 01 123 690.8–1251.

* cited by examiner

*Primary Examiner*—Shih-Wen Hsieh
(74) *Attorney, Agent, or Firm*—Fitzpatrick, Cella, Harper & Scinto

(57) ABSTRACT

A head recovery device for an ink jet recording apparatus is provided with a pigment ink discharge port for discharging pigment ink and a dye ink discharge port for discharging dye ink. The device comprises a pigment ink cap for capping the pigment ink discharging port and a dye ink cap for capping the dye ink discharge port, and, in a predetermined recovery operation, a preliminary discharge is executed from the dye ink discharge port to the pigment ink cap.

24 Claims, 21 Drawing Sheets

HEAD RECOVERY DEVICE, HEAD RECOVERY METHOD AND INK JET RECORDING APPARATUS

BACKGROUND OF THE INVENTION

1. Field of the Invention

The present invention relates to a head recovery device and a head recovery method for recording means provided with a pigment ink discharge port for discharging pigment ink and a dye ink discharge port for discharging dye ink, and an ink jet recording apparatus executing such head recovery.

2. Related Background Art

The recording apparatus having the function of a printer, a copying apparatus or a facsimile machine or employed as the output device for a composite electronic device including a computer or a word processor or for a work station serves to record an image (including a character or a symbol) on a recording material (recording medium) such as paper, fabric, plastic sheet or OHP sheet. Among the various types of recording apparatus, the ink jet system (ink jet recording apparatus) forms a record by discharging ink from recording means (recording head) onto the recording material, and has various advantages, such as easy compactization of the recording means, high-speed recording of a high definition image, recording on plain paper without any particular process, a low running cost, a low noise level because it is a non-impact system, and easy recording of a color image with plural inks (for example color inks).

The energy used for discharging ink from the discharge port of an ink jet recording head can be generated, for example, by an electromechanical converting member such as a piezoelectric element, by irradiation of an electromagnetic wave such as laser light to generate heat thereby discharging an ink droplet, or by an electrothermal converting member including a heat generating resistor for heating liquid. Among these methods, the recording means (recording head) of ink jet type utilizing thermal energy for discharging ink as a droplet is capable of recording at a high resolution because the discharge ports can be arranged at a high density. Among such recording means, a recording head utilizing an electrothermal converting member, or the like, as the energy generating element is advantageous because it can be easily made compact, can fully utilize the advantages of the IC microprocessing technology, which is showing remarkable progress in the semiconductor area and in reliability, and also can be realized in a high density with a low manufacturing cost.

Also there are various requirements for the quality of the recording media, and developments have recently been made for meeting such requirements so that there have been developed recording apparatuses that utilize not only the ordinary recording media such as paper (including thin paper and processed paper) and thin plastic plate (for example OHP sheet) but also fabric, leather, non-woven cloth and metal.

The recording apparatus can be classified as either a serial type, in which the recording is executed by a main scanning operation in a direction crossing the conveying direction of the recording sheet (recording material), or a line type, in which the recording is executed by a recording head supported in a fixed position and having such a length as to cover a predetermined width range (including the entire width) in the transversal direction of the recording sheet. The present invention is applicable to any type of recording apparatus, including the aforementioned recording types. In the ink jet recording apparatus of the above-mentioned serial type, an image is formed on the recording sheet by recording the image (including characters and symbols) by a recording head mounted on a carriage moving along the recording sheet and thereafter conveying the sheet by a predetermined amount (sub scanning).

In the above-described ink jet recording apparatus, an undesirable substance, such as an ink droplet, dust or paper dust, may be deposited on the head face of the recording head during the recording operation, and a cleaning operation of the head face is executed with a cleaning member (for example, wiping or rubbing) in order to eliminate such undesirable substance. Such cleaning member is usually composed of a flexible member, such as a rubber blade, consisting of a rubber-like elastic material.

Also, clogging of the discharge port may result by drying of the ink in the vicinity of the discharge port of the recording head, causing viscosity increase, solidification or deposition of the ink. The clogging of the discharge port may also result from a bubble generated inside the discharge port (flow path) or by dust. In order to recover from (prevent or eliminate) such clogging, there is adopted a suction recovery method of forming a closed system at the ink discharge port portion with a capping member and generating a certain negative suction force at the discharge port face (head face) with a pump, thereby forcedly discharging ink from the discharge port. Also, in order to remove the ink attached to the head face by the suction recovery, there is executed a cleaning (wiping) operation of the head face with a cleaning member.

In the following there will be explained the head recovery device and the heat recovery method of the conventional ink jet recording apparatus with reference to FIGS. 13 and 14. FIG. 13 is a schematic elevation view of a heat recovery device for the conventional ink jet recording apparatus, seen from the front, and FIG. 14 is a schematic lateral view of the heat recovery device shown in FIG. 13, seen from the lateral direction. Referring to FIGS. 13 and 14, there are shown a black head (pigment ink head) 1A for discharging black pigment ink, a color head (dye ink head) 1B for discharging dye inks of different colors (for example cyan, magenta and yellow), a main scanning carriage 2 for positioning and supporting the black head 1A and the color head 1B, and a main scanning rail 3 for guiding and supporting the main scanning carriage 2 in a state capable of reciprocating motion in a direction A which is the recording direction.

There are also shown a rubber cap (for pigment ink head) 4A for forming a closed system (capping) on a discharge port portion 1Aa of the black head 1A, and a rubber cap (for dye ink head) 4B for forming a closed system (capping) on a discharge port portion 1Ba of the color head 1B. These rubber caps 4A, 4B are so positioned and supported by an unrepresented holder member as to be movable by an unrepresented drive source in a capping direction B and in an uncapping direction C, whereby constituted are capping means for the pigment ink head and that for the dye ink head.

Referring to FIGS. 13 and 14, cap absorbing members 9A, 9B for absorbing and retaining ink are provided respectively inside the rubber caps 4A, 4B. Also, in order to prevent solidification and deposition of the inks at the discharge port portions 1Aa, 1Ba by viscosity increase of the inks, preliminary ink discharges are executed from the discharge ports to the cap absorbing members 9A, 9B at predetermined time intervals, even in the course of a recording (printing) operation. There are also provided a suction pump (suction means) 5A for the black head (pigment ink head) and a suction pump (suction means) 5B for the color head (dye ink head). The pumps generate a predetermined suction pressure (negative pressure) at the discharge port portions 1Aa, 1Ba in the capped state, thereby executing a suction recovery operation (recovery process) of forcedly sucking ink from the discharge port portions 1Aa, 1Ba through first tubes 6A, 6B. The pumps discharge the sucked ink into a used ink processing member 8 through second tubes 7A, 7B. There are also provided a cleaning member 10A for the black head (pigment ink head) and a cleaning member 10B for the color head (dye ink head), which are composed of rubber, such as urethane rubber, butyl rubber or silicone rubber, or a porous material, such as sponge.

The cleaning members 10A, 10B are rendered movable in directions D and E by an unrepresented drive source, and, by a movement in the direction D, they come into sliding contact (represented by broken lines) with the head face including the discharge port portions 1Aa, 1Ba to execute a cleaning operation (wiping operation). After the cleaning operation, the cleaning members 10A, 10B further move in a direction D to come into contact with cleaners 111A, 11B (represented by broken lines), whereby the ink droplet, dust, paper dust etc. scraped off from the head face and deposited on the cleaning members 10A, 10B are recovered by transfer to the respectively corresponding cleaners 11A, 11B. In this operation, the caps 4A, 4B of the capping means are moved (retracted) in a direction C by an unrepresented drive source to a position (not shown) not interfering with the cleaning members 10A, 10B of the cleaning means.

In case the ink droplet discharge becomes unstable or impossible, it is necessary to restore the normal ink discharge state by eliminating such failure and the aforementioned recovery means (discharge failure recovery means) is provided as the operation means therefor. As one of such recovery means, there is employed suction recovery means for capping the discharge port of the recording head (for example a recording head cartridge) and applying a negative pressure to the discharge port for example by a suction pump thereby forcedly discharging ink from the recording head. However the recovery means of such negative pressure suction type has been associated with a technical drawback of consuming a large amount of ink for the suction recovery operation.

In order to resolve such technical drawback, there has been proposed, as disclosed for example in the Japanese Patent Application Laid-open No. 2-102058, an ink jet recording apparatus so constructed, upon completion of the recording with the ink jet recording head cartridge, as to discharge a certain amount of the ink droplets from the recording head cartridge and thereafter capping the recording head cartridge (sealing of the discharge port) by pressing a cap thereto.

Also the Japanese Patent Application Laid-Open No. 4-339665 proposes an ink jet recording apparatus so constructed, upon completion of the ink jet recording, as to execute the capping operation after discharging a predetermined amount of the ink droplets into the Interior of the corresponding cap based on the result of detection such as the period in which the recording head cartridge is kept in an open-cap state or the amount of recording.

However, in the conventional head recovery device and head recovery method explained in the foregoing and in the ink jet recording apparatus employing or executing such apparatus or method, though the durability of the various components of the apparatus are not affected in case of dye-based ink (dye ink), the pigment-based ink (pigment ink) shows faster viscosity increase or solidification in comparison with the dye ink and is deposited by such viscosity increase or solidification in the cap absorbing member 9A of the cap 4A for the pigment ink head, whereby the removal of the ink by the aforementioned suction operation may become difficult and the suction ability for the recovery may also be deteriorated. Furthermore the ink is deposited by viscosity increase and solidification at the contact portion of the cap 4A with the pigment ink head 1A to generate a step by the deposited and solidified ink at such contact portion of the cap 4A with the head face, thereby resulting in defective sealing at the capping operation.

Such phenomenon is presumably ascribable to the following. As the pigment-based ink is prepared by dispersing pigment such as carbon black into an aqueous medium, once the aqueous component is evaporated, the pigment particles coagulate and are difficult to dissolve again. Such difficulty in re-dissolution is desirable for the image characteristics but undesirable for the protection of the recording head (recording head cartridge etc.). More specifically, if the pigment-based ink is discharged and remains in the cap for a long time after the recording operation, the pigment ink itself solidifies in the cap and the recovery operation at the re-start of the recording operation cannot realize the stable suction operation whereby it may become difficult to maintain or restore the ink discharging performance of the recording head.

SUMMARY OF THE INVENTION

An object of the present invention is to provide a head recovery device, a head recovery method and an ink jet recording apparatus capable of easily and securely eliminating the deposited and solidified pigment ink. This is accomplished by dissolving pigment ink, deposited and solidified in the capping means for the pigment ink discharge port (also serving as means for receiving the preliminary discharge) and in the preliminary discharge receiving means, with dye ink.

Another object of the present invention is to provide a head recovery device, a head recovery method and an ink jet recording apparatus capable of stably executing the recovery operation for the recording means at the re-start of the recording operation by preventing the drying of the discharge port of the recording means and in the vicinity thereof even in case of a prolonged standing in the capped state.

Still another object of the present invention is to provide a head recovery device for use in an ink jet recording apparatus provided with a pigment ink discharge port for discharging pigment ink and a dye ink discharge port for discharging dye ink, comprising a pigment ink cap for capping the pigment ink discharge port and a dye ink cap for capping the dye ink discharge port, wherein, in a predetermined recovery operation, a preliminary discharge is executed from the dye ink discharge port into the pigment ink cap.

Still another object of the present invention is to provide a head recovery device for use in an ink jet recording apparatus provided with a pigment ink discharge port for discharging pigment ink and a dye ink discharge port for discharging dye ink, comprising a pigment ink cap for capping the pigment ink discharge port and a dye ink cap for capping the dye ink discharge port, wherein, in a predetermined recovery operation, the dye ink discharge port is capped by the pigment ink cap and a suction operation is executed from the dye ink discharge port.

Still another object of the present invention is to provide a head recovery device for use in an ink jet recording apparatus provided with a pigment ink discharge port for discharging pigment ink and a dye ink discharge port for discharging dye ink, comprising a pigment ink receiver for receiving the droplets of the pigment ink discharged from the pigment ink discharge port in a preliminary discharge irrelevant from the recording operation and a dye ink receiver for receiving the droplets of the dye ink discharged from the dye ink discharge port in a preliminary discharge, wherein, in a predetermined recovery operation, a preliminary discharge is executed from the dye ink discharge port into the pigment ink receiver.

Still another object of the present invention is to provide an ink jet recording apparatus provided with a pigment ink discharge port for discharging pigment ink and a dye ink discharge port for discharging dye ink, comprising a pigment ink cap for capping the pigment ink discharge port and a dye ink cap for capping the dye ink discharge port, wherein, in a predetermined recovery operation, a preliminary discharge is executed from the dye ink discharge port into the pigment ink cap.

Still another object of the present invention is to provide an ink jet recording apparatus provided with a pigment ink discharge port for discharging pigment ink and a dye ink discharge port for discharging dye ink, comprising a pigment ink cap for capping the pigment ink discharge port and a dye ink cap for capping the dye ink discharge port, wherein, in a predetermined recovery operation, the dye ink discharge port is capped by the pigment ink cap and a suction operation is executed from the dye ink discharge port.

Still another object of the present invention is to provide an ink jet recording apparatus provided with a pigment ink discharge port for discharging pigment ink and a dye ink discharge port for discharging dye ink, comprising a pigment ink receiver for receiving the droplets of the pigment ink discharged from the pigment ink discharge port in a preliminary discharge irrelevant from the recording operation and a dye ink receiver for receiving the droplets of the dye ink discharged from the dye ink discharge port in a preliminary discharge, wherein, in a predetermined recovery operation, a preliminary discharge is executed from the dye ink discharge port into the pigment ink receiver.

Still another object of the present invention is to provide a head recovery method for an ink jet recording apparatus provided with a pigment ink discharge port for discharging pigment ink and a dye ink discharge port for discharging dye ink, comprising a step of executing a preliminary discharge, irrelevant from the recording operation, from the pigment ink discharge port into the pigment ink cap for capping the pigment ink discharge port, a step of executing a preliminary discharge from the dye ink discharge port into the dye ink cap for capping the dye ink discharge port, and a step of executing preliminary discharge from the dye ink discharge port into the pigment ink cap.

Still another object of the present invention is to provide a head recovery method for an ink jet recording apparatus provided with a pigment ink discharge port for discharging pigment ink and a dye ink discharge port for discharging dye ink, comprising a step of executing suction from the pigment ink discharge port when it is capped by the pigment ink cap, a step of executing suction from the dye ink discharge port when it is capped by the dye ink cap, and a step of executing suction from the dye ink discharge port when it is capped by the pigment ink cap.

According to the present invention, there are provided a head recovery device, a head recovery method and an ink jet recording apparatus capable of easily and securely removing the deposited and solidified pigment ink by dissolving the pigment ink, deposited and solidified in the capping means for the pigment ink discharge port or in the preliminary discharge receiving means, by the dye ink. Prior to the capping of the recording means (recording head cartridge or the like) after the recording operation, the dye ink is discharged in the cap to maintain the interior of the cap in a moist state even in case the recording means is left standing in the capped state for a prolonged period, whereby the viscosity increase or solidification of the ink can be avoided in the cap even if moisture evaporation proceeds. It is therefore rendered possible to easily realize stable ink discharge and image recording at the re-start of the recording operation, and, if the recording means is not in a satisfactory condition and requires a recovery operation, to securely execute the suction recovery operation by sucking the ink from the discharge port through the cap, thereby easily achieving stable and secure recovery operation, Also there can be provided a head recovery device, a head recovery method and an ink jet recording apparatus capable of more efficiently attaining the aforementioned effects by a configuration in which the pigment ink head for discharging the pigment ink is positioned closer to the recording area than the dye ink head for discharging the dye ink and the capping means for the pigment ink head is positioned closer to the recording area than the capping means for the dye ink head.

It is also possible to dissolve and remove the pigment of a wide area, deposited and solidified for example in the contact portion of the cap with the head face, in a predetermined recovery operation, by executing preliminary discharge of the dye ink from the dye ink discharge port to the contact portion of the pigment ink cap with the discharge port face including the pigment ink discharge port.

It is also possible to dissolve and remove the pigment of a wide area, deposited and solidified for example in the capping means or the suction pump for the pigment ink head, in a predetermined recovery operation, by sucking the ink from the dye ink discharge port by the capping means and suction means for the pigment ink discharge port.

DETAILED DESCRIPTION OF THE PREFERRED EMBODIMENTS

Figure 1:
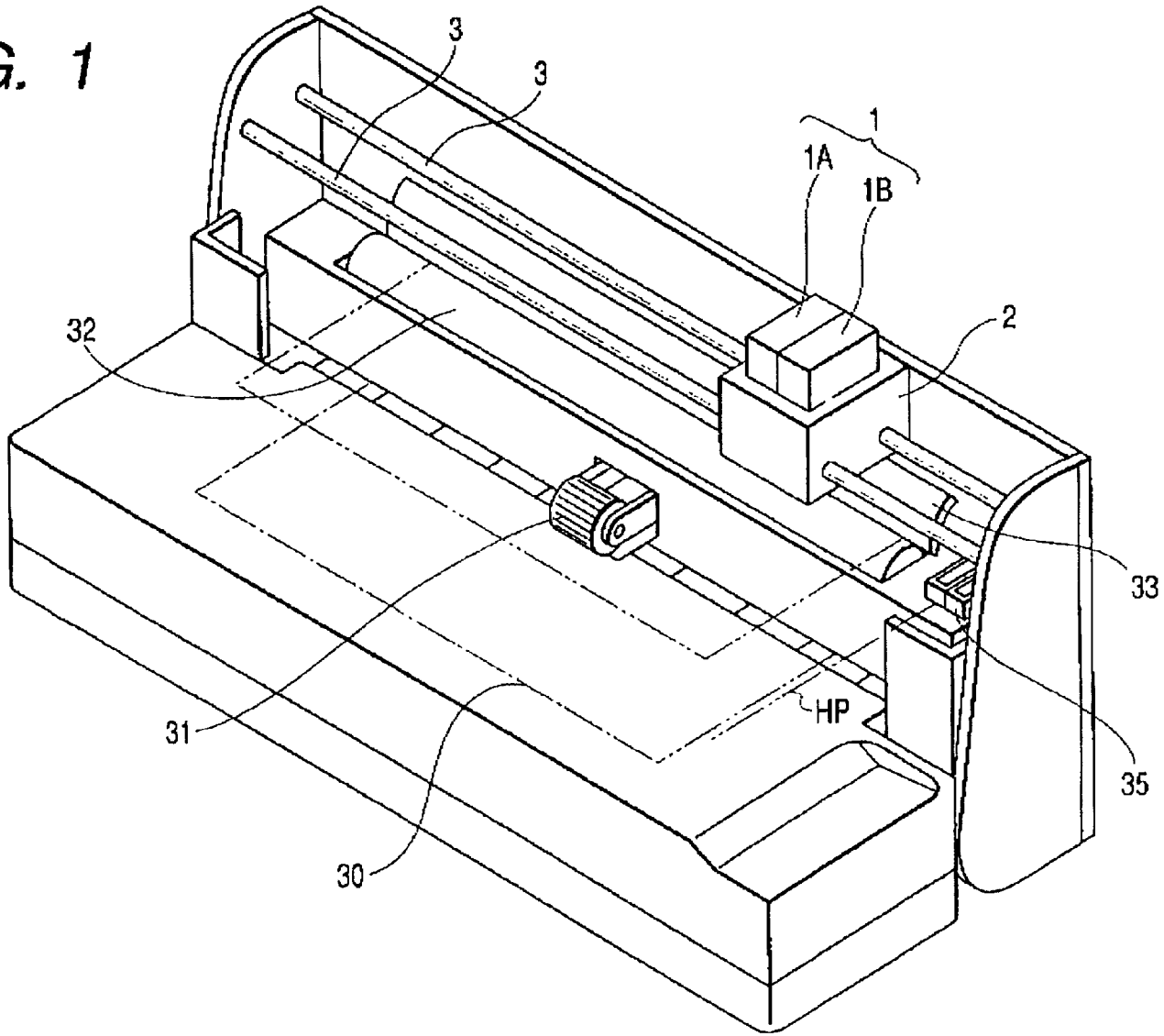
FIG. 1 is a schematic perspective view showing the configuration of an ink jet recording apparatus embodying the present invention.

Now the present invention will be clarified in detail by embodiments thereof, with reference to the accompanying drawings. FIG. 1 is a schematic perspective view showing the configuration of an ink jet recording apparatus embodying the present invention, wherein a main scanning carriage 2 is mounted with a pigment ink head (for example, a black head) 1A for discharging pigment ink (for example, black pigment ink) and a dye ink head (for example, a color head) 1B for discharging dye ink (for example, color dye inks of cyan, magenta, yellow etc.), and is supported by a main scanning rail 3 so as to be capable of reciprocating motion in the main scanning direction (direction of the main scanning rail 3) by an unrepresented drive source.

A recording material 30, such as a recording sheet, is fed into the main body of the apparatus by a feed roller 31. The recording material is then supported by a pinch roller (not shown) and a paper pressure plate 33 on a sheet feeding roller (conveying roller) 32 and fed (conveyed), by the controlled rotation of the sheet feeding roller 32, through a position of a predetermined distance from the front face (lower head face in the illustrated example) of the recording means (recording head) 1 constituted by the aforementioned pigment ink head 1A and dye ink head 1B. As the recording material is conveyed, it receives the recording (printing) of an image (including a character, etc.) by the driving of the recording head 1 based on recording information. A home position HP of the main scanning carriage 2 is defined within the movable range thereof, but outside the recording area (right-hand end portion in the drawing).

In the vicinity of the home position HP, there is provided a head recovery device 35 including capping means provided with elastic rubber caps capable of contacting the head faces (face having the discharge ports) of the pigment ink head 1A and the dye ink head 1B thereby sealing the discharge ports suction means including a suction pump capable of generating a negative suction force at the discharge ports through the caps in a capped state, and cleaning means including cleaning members coming into sliding contact with the head faces of the pigment ink head 1A and the dye ink head 1B for scraping (wiping) off deposits, such as ink and dust. The head recovery device 35 serves to execute a recovery operation for restoring the ink discharge ability of the recording head by generating a negative pressure, by means of the suction pump, in the cap while the discharge port portion of the recording head is capped, thus eliminating the increased-viscosity ink, bubble, solidified ink, dust, etc. by sucking out such deposits with the ink from the discharge port by means of such negative pressure.

The pigment ink head 1A and the dye ink head 1B, constituting the recording means (recording head) 1, are ink jet recording heads for discharging ink utilizing thermal energy and are provided with electrothermal converting members for generating thermal energy. The aforementioned recording means 1 (pigment ink head 1A and dye ink head 1B) generates film boiling in the ink by the thermal energy applied by the electrothermal converting member and discharges the ink from the discharge port utilizing a pressure change resulting from the growth and contraction of a bubble generated by such film boiling, thereby executing recording (printing).

Figure 2:
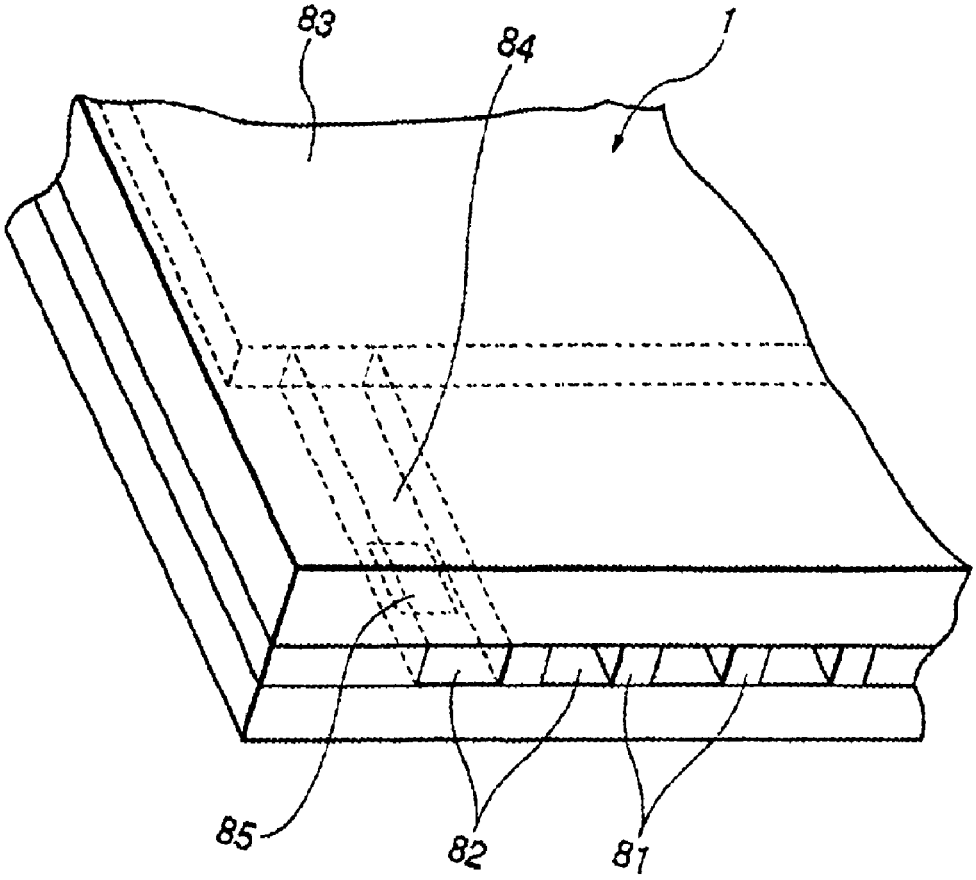
FIG. 2 is a partial perspective view schematically showing the configuration of an ink discharge portion of a recording head shown in FIG. 1.

FIG. 2 is a partial perspective view schematically showing the configuration of an ink discharge portion of the recording head 1, wherein a discharge port face 81 opposed to the recording material 30 with a predetermined distance (for example about 0.3 to 2.0 mm) is provided with plural discharge ports 82 (corresponding to discharge ports 1Aa, 1Ba to be explained later) at a predetermined pitch, and an electrothermal converting member (heat generating member) 85 for generating ink discharging energy is provided along a wall surface of each of liquid paths 84 connecting the discharge ports 82 and a common liquid chamber 83. The recording head 1 is mounted on the main scanning carriage 2 in such a manner that the discharge ports 82 are arranged in a direction crossing the main scanning direction (reciprocating direction of the recording head 1). The recording head (pigment ink head 1A and dye ink head 1B) is so constructed as to drive (energize) the corresponding electrothermal converting members according to image signals or discharge signal to cause film boiling in the ink in each liquid path 84, thereby discharging ink from each discharge port 82 by the pressure at such film boiling.

Figure 3:
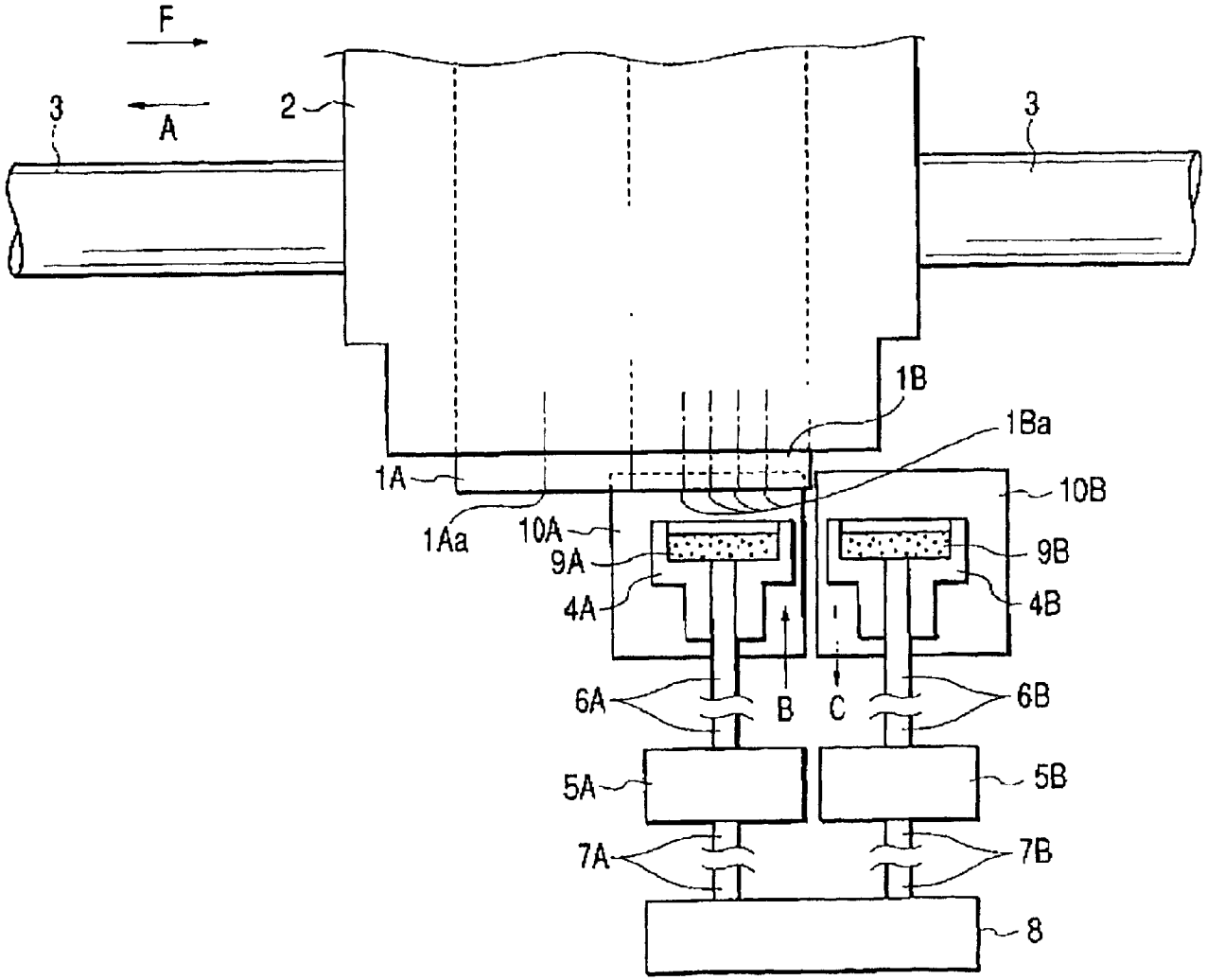
FIG. 3 is a schematic elevation view showing, in an embodiment of the head recovery device for the ink jet recording apparatus, a non-capped state in which a dye ink head (dye ink discharge port) is opposed to a cap (capping means) for a pigment ink head (pigment ink discharge port)
Figure 4:
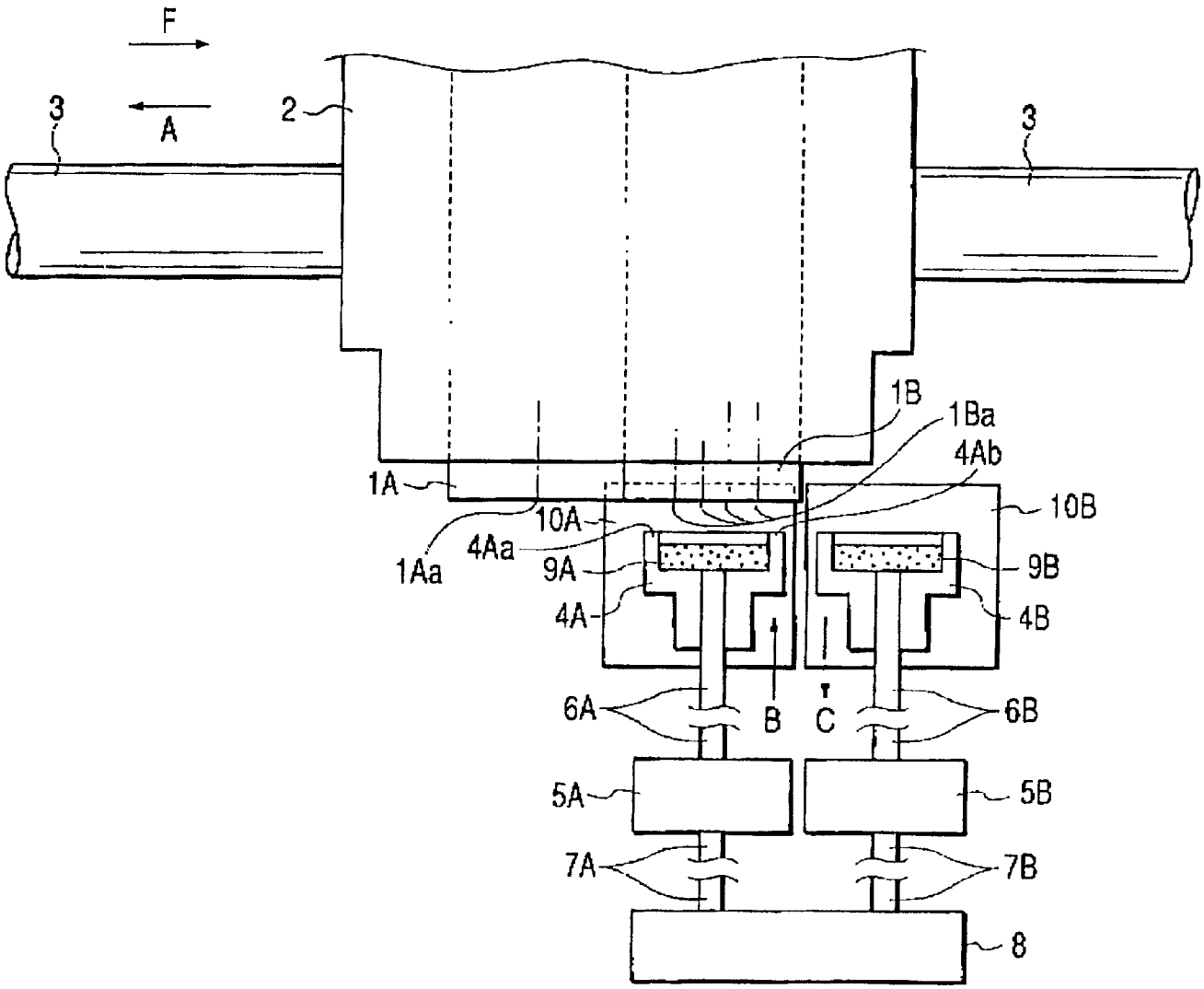
FIG. 4 is a schematic elevation view of the head recovery device shown in FIG. 3, in which contact portions (head face contact portions) 4Aa, 4Ab of the cap for the pigment ink head that contact the head face (discharge port face) are additionally illustrated.
Figure 5:
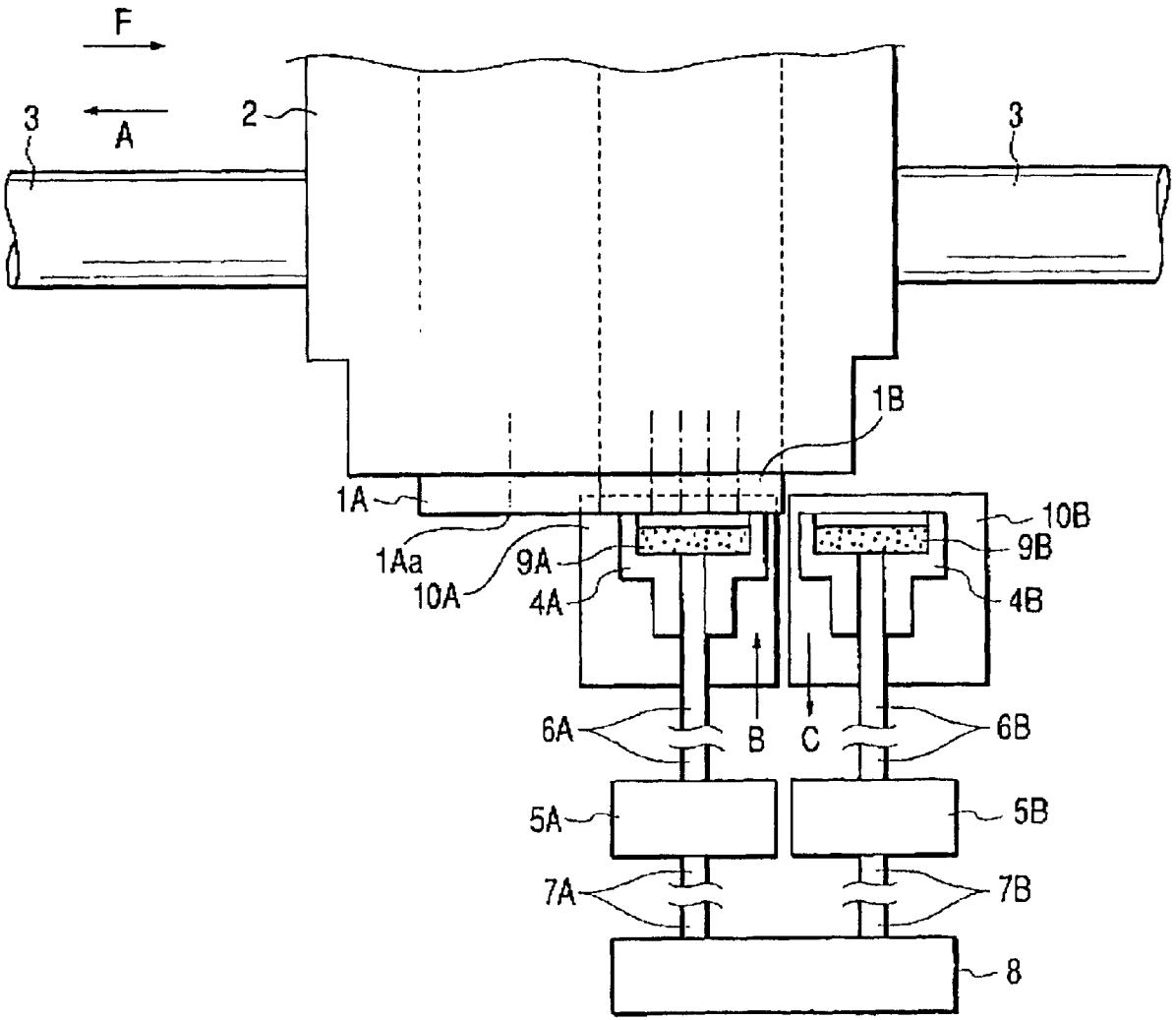
FIG. 5 is a schematic elevation view showing, in the head recovery device shown in FIG. 3, a capped state in which the dye ink head is opposed to the cap for the pigment ink head.
Figure 6:
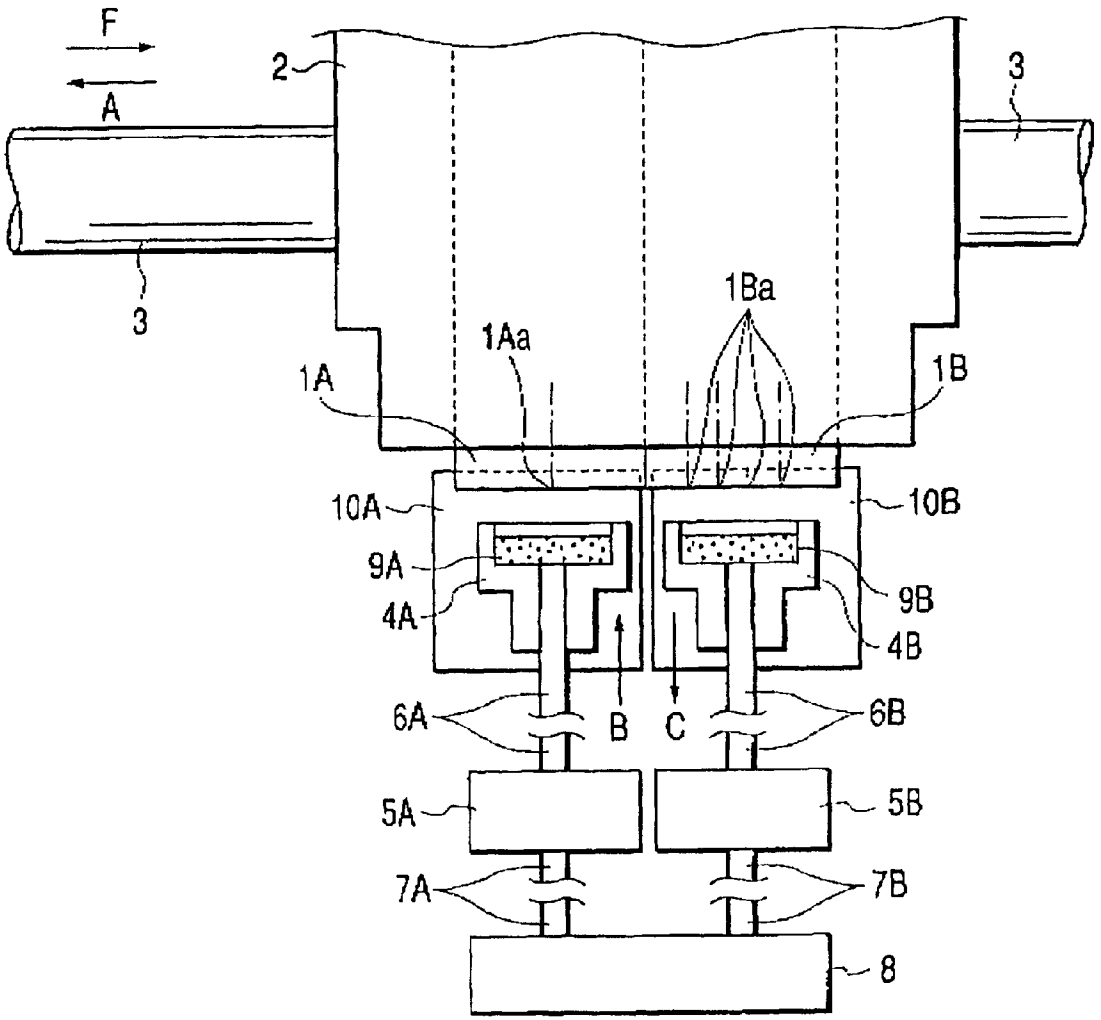
FIG. 6 is a schematic elevation view showing, in the head recovery device shown in FIG. 3, a non-capped state in which the pigment ink head 1A is opposed to the cap 4A for the pigment ink head and the dye ink head 1B is opposed to the cap 4B for the dye ink head.
Figure 7:
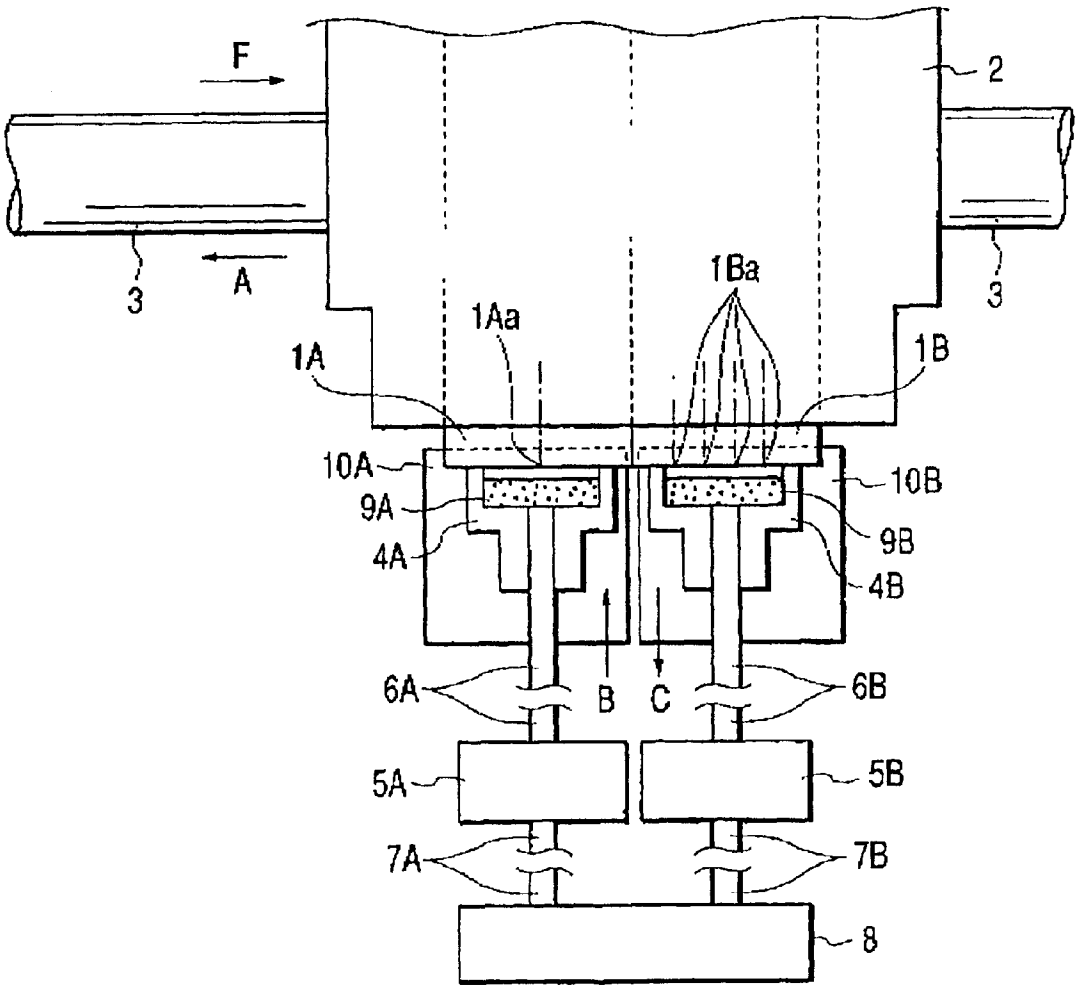
FIG. 7 is a schematic elevation view showing, in the head recovery device shown in FIG. 3, a capped state in which the pigment ink head 1A is opposed to the cap 4A for the pigment ink head and the dye ink head 1B is opposed to the cap 4B for the dye ink head.

The head recovery device 35, shown in FIG. 1, has a configuration embodying the present invention. FIG. 3 is a schematic elevation view of the head recovery device 35 in a non-capped state in which the dye ink head 1B (dye ink discharge port 1Ba) is opposed to the cap (capping means) 4A for the pigment ink head (pigment ink discharge port); FIG. 4 is a schematic elevation view additionally showing contact portions (with the head face/discharge port face) 4Aa, 4Ab of the cap 4A for the pigment ink head that contact the head face (discharge port face). Also, FIG. 5 is a schematic elevation view of the head recovery device 35 in a capped state in which the dye ink head 1B is opposed to the cap 4A for the pigment ink head; FIG. 6 is a schematic elevation view of the head recovery device 35 in a non-capped state in which the pigment ink head 1A (pigment ink discharge port 1Aa) is opposed to the cap (capping means) 4A for the pigment ink head (pigment ink discharge port) and the dye ink head 1B is opposed to the cap (capping means) 4B for the dye ink head; and FIG. 7 is a schematic elevation view of the head recovery device 35 in a capped state in which the pigment ink head 1A is opposed to the cap 4A for the pigment ink head and the dye ink head 1B is opposed to the cap 4B of the dye ink head.

Figure 8:
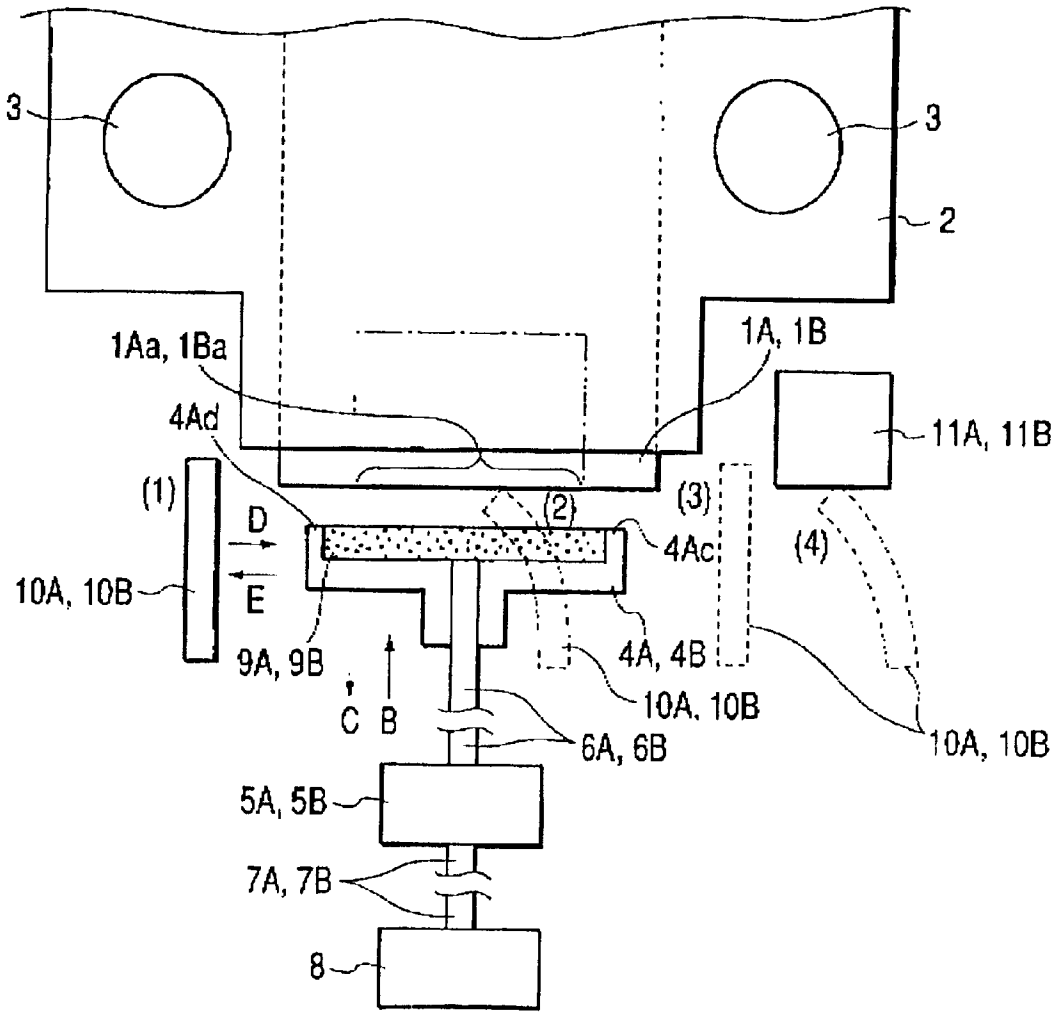
FIG. 8 is a schematic lateral view showing, in the head recovery device shown in FIG. 3, a non-capped state in which at least either of the pigment ink head 1A and the dye ink head 1B is opposed to at least either of the cap 4A for the pigment ink head and the cap 4B for the dye ink head.
Figure 9:
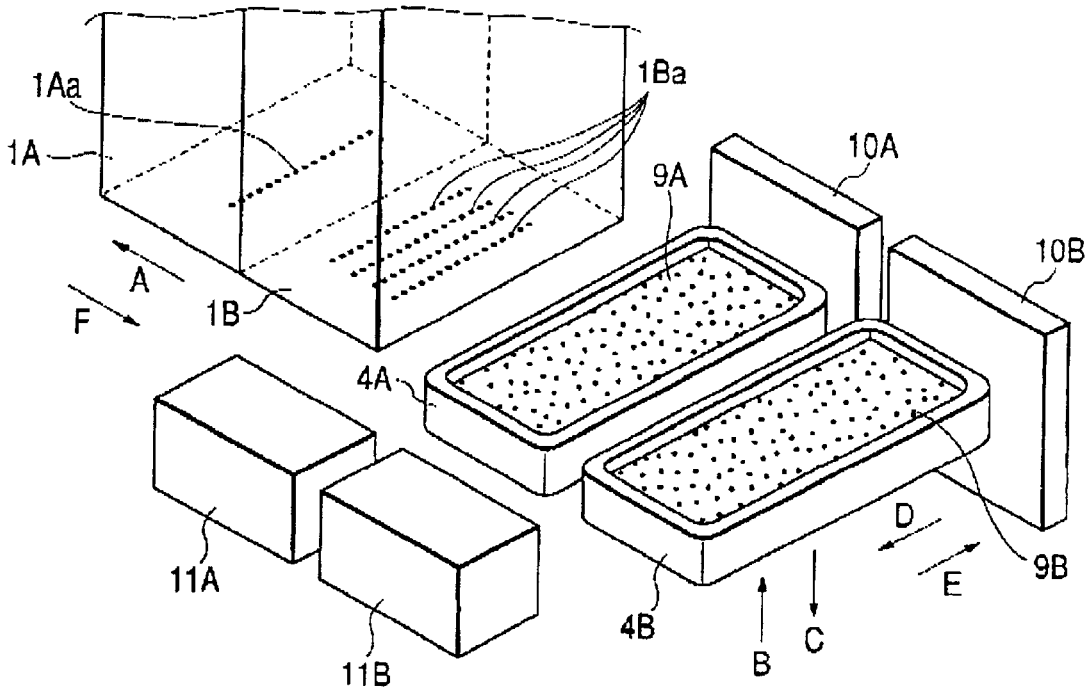
FIG. 9 is a schematic perspective view of the head recovery device shown in FIG. 3, seen from obliquely above.
Figure 10:
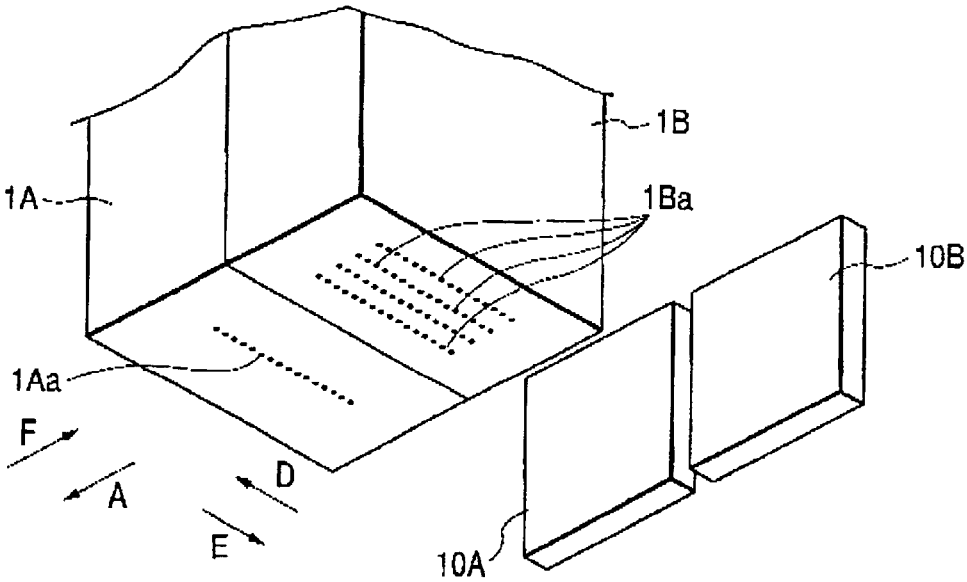
FIG. 10 is a schematic perspective view of the cleaning means of the head recovery device shown in FIG. 3, together with the head (discharge port), seen from below.
Figure 11:
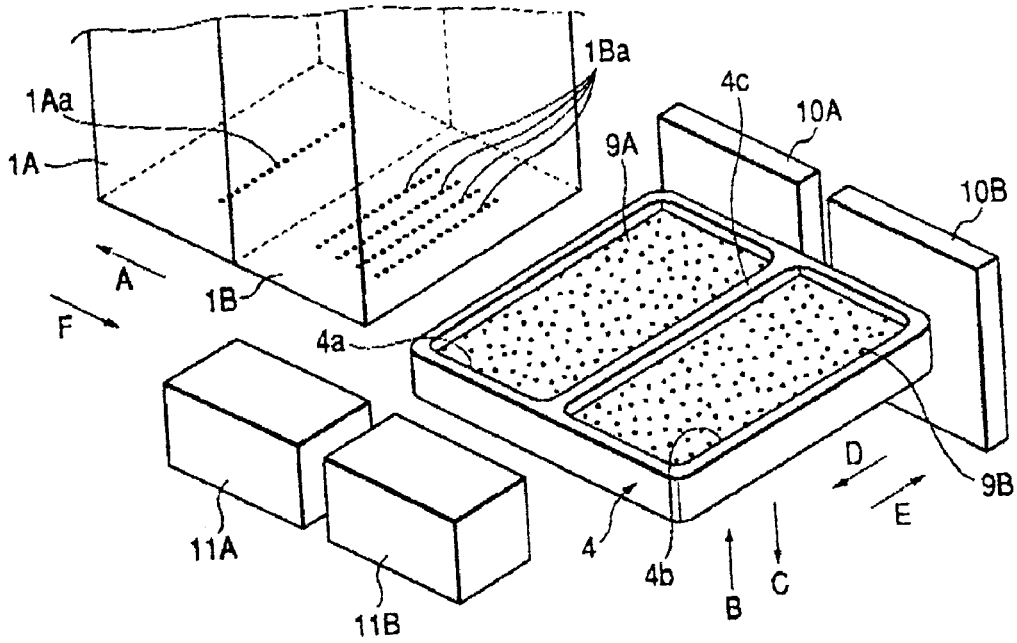
FIG. 11 is a schematic perspective view of another embodiment of the head recovery device of the present invention, seen from obliquely above.
Figure 12:
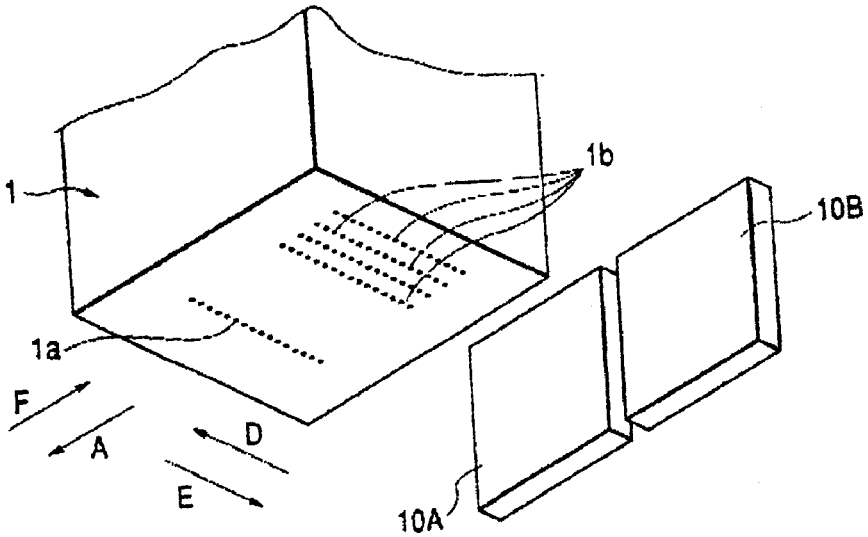
FIG. 12 is a schematic perspective view of a cleaning member of the head recovery device of the present invention and an integral head, seen from below.
Figure 13:
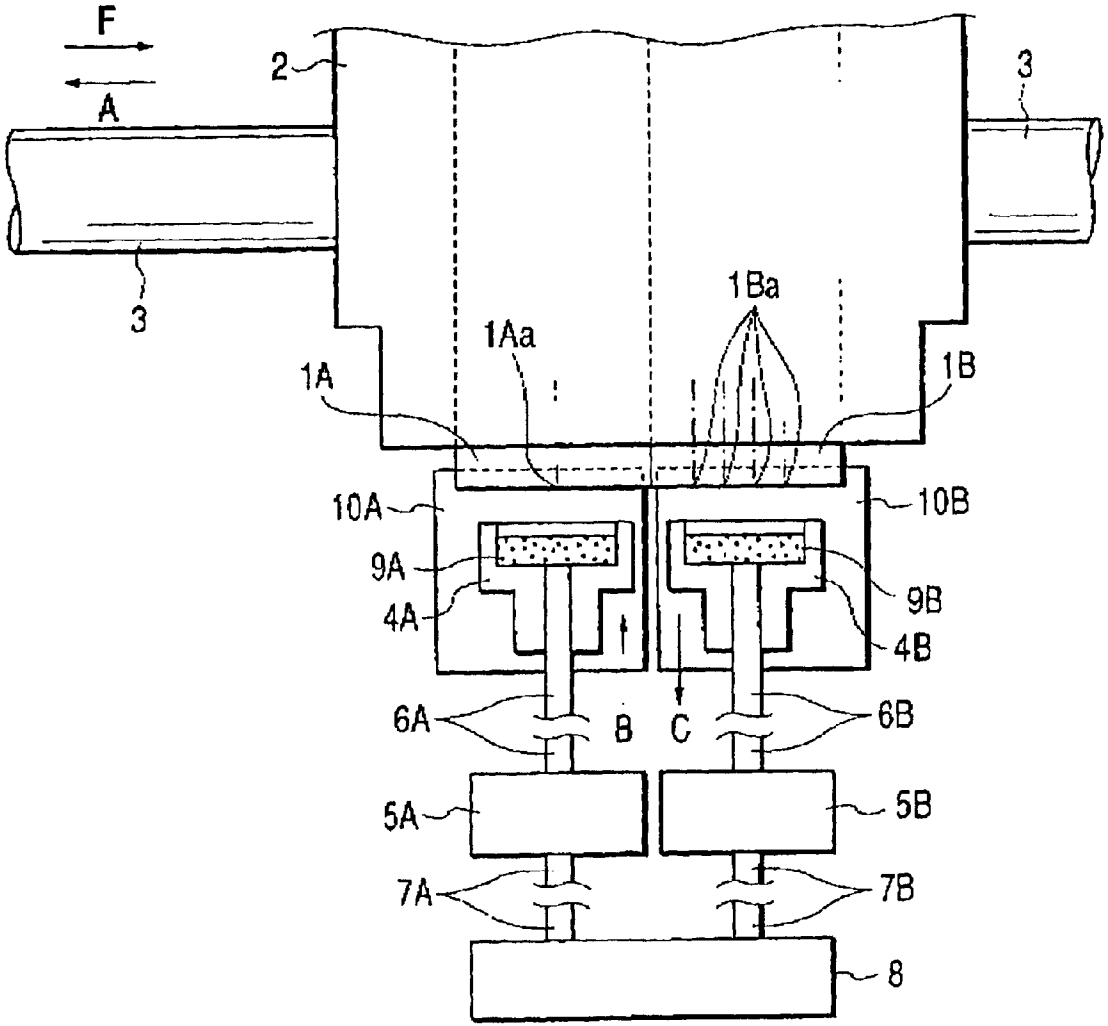
FIG. 13 is a schematic elevation view of a head recovery device for an ink jet recording apparatus, for explaining a conventional recovery operation.
Figure 14:
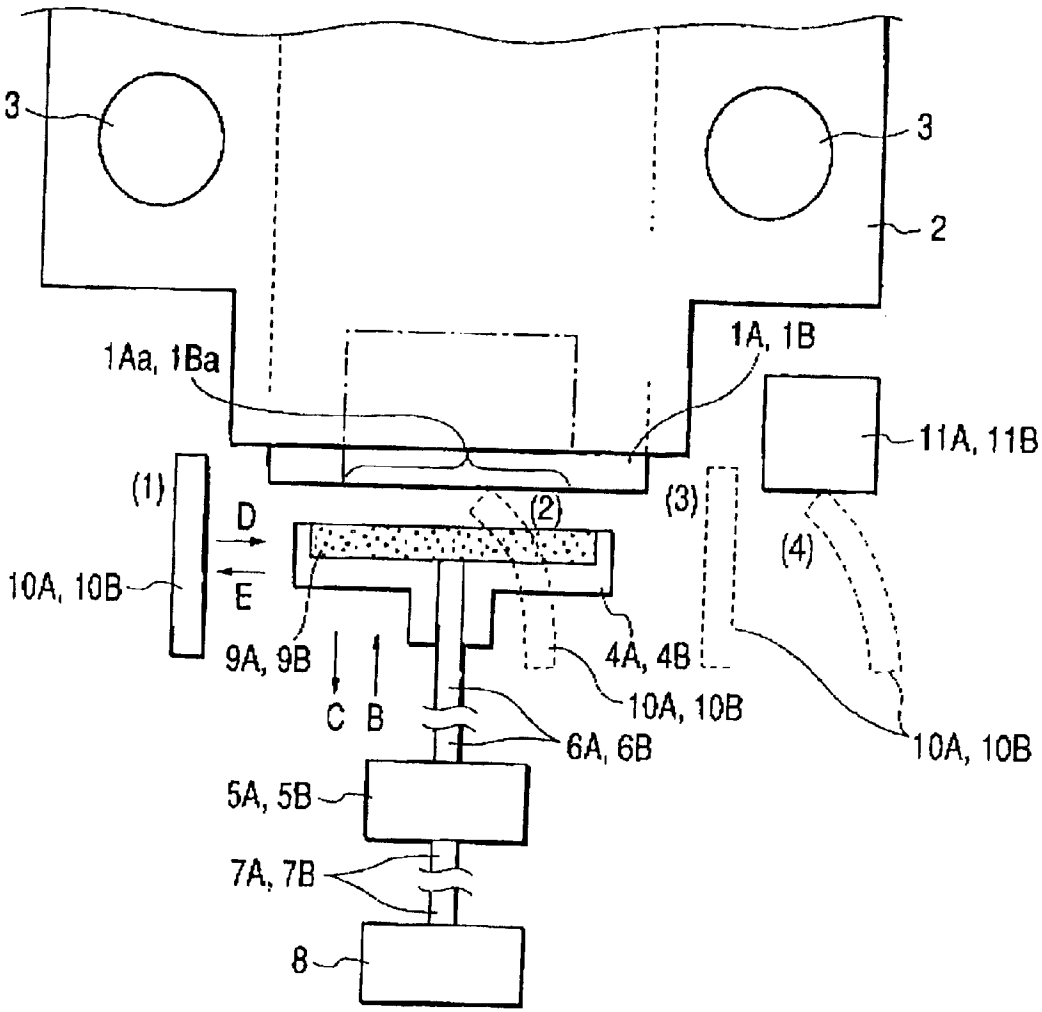
FIG. 14 is a schematic lateral view of a head recovery device for an ink jet recording apparatus, for explaining a conventional recovery operation.

Further, FIG. 8 is a schematic lateral view of the head recovery device 35 in a non-capped state in which at least either of the pigment ink head 1A and the dye ink head 1B is opposed to at least either of the cap 4A for the pigment ink head and the cap 4B for the dye ink head, while FIG. 9 is a schematic perspective view of the head recovery device 35 seen from obliquely above, FIG. 10 is a schematic perspective view showing the head recovery device 35 together with the recording head, seen from below, FIG. 11 is a schematic perspective view showing another embodiment of the head recovery device of the present invention, seen from obliquely above, and FIG. 12 is a schematic perspective view of cleaning members of the head recovery device of the present invention, together with an integral recording head seen from below.

At first there will be explained an ordinary head recovery operation with reference to FIGS. 6 to 10, in which there are shown a pigment ink head (black head) 1A for discharging pigment ink (for example black ink), a dye ink head (color head) 1B for discharging dye ink (for example color ink), a main scanning carriage 2 for supporting the pigment ink head 1A and the dye ink head 1B, a pair of main scanning rails 3 for guiding the main scanning carriage 2 so as to enable a reciprocating motion in the recording direction A, an elastic rubber cap 4A (capping means, also usable as preliminary discharge receiving means) for contacting the discharge port portion 1Aa of the pigment ink head 1A thereby forming a closed state, and an elastic rubber cap 4B (capping means, also usable as preliminary discharge receiving means) for contacting the discharge port portion 1Ba of the pigment ink head 1B thereby forming a closed state. These caps 4A, 4B are positioned and supported by an unrepresented holder member so as to be movable in a capping direction B and an uncapping direction C by an unrepresented driving source.

Ink absorbing members 9A, 9B, provided in the aforementioned caps 4A, 4B, are composed of a porous or sponge-like material capable of absorbing and containing the ink. As shown in FIG. 6, the discharge ports 1Aa, 1*a* of the heads 1A, 1B execute preliminary discharge of ink toward the ink absorbing members 9A, 9B in a non-capped state in which the caps 4A, 4B are spaced from the heads 1A, 1B. The preliminary discharge is an operation for preventing viscosity increase or solidification of the ink in the discharge port portions 1Aa, 1Ba in the course of the recording operation, and is usually executed at a predetermined time interval. The preliminary discharge may be executed toward an unrepresented preliminary discharge receiving means, which may be composed of a container or an ink absorbing member.

There are also provided a suction pump (suction means) 5A for the pigment ink head (pigment ink discharge port) and a suction pump (suction means) 5B for the dye ink head (dye ink discharge port). In a capped state in which the caps 4A, 4B are contacted with the heads 1A, 1B, as shown in FIG. 7, there is executed a suction recovery operation. The pumps generate a predetermined negative suction pressure (suction force) at the discharge ports 1Aa, 1Ba of the heads 1A, 1B to forcedly suck the ink from the discharge port portions 1Aa, 1Ba through the first tubes 6A, 6B. Then, the pumps discharge the sucked ink to the used ink processing member 8 through the second tubes 7A, 7B. The aforementioned suction pumps (suction means) 5A, 5B are used for executing such suction recovery operation, which is executed whenever considered necessary. For example, the suction recovery operation may occur immediately before the start of the recording operation, at every predetermined time or recording amount in the course of the recording operation, or when a detection result indicates that the head recovery operation has become necessary.

There are also provided a cleaning member (cleaning means) 10A for the pigment ink head (black head) and a cleaning member (cleaning means) 10B for the dye ink head (color head), and such cleaning members are composed of a rubber-like, porous or sponge-like material such as urethane rubber, butyl rubber or silicone rubber. The cleaning members 10A, 10B are rendered movable in directions D and B (FIGS. 8 to 10) by an unrepresented drive source, and, by a movement in the direction D, they come into sliding contact (represented by broken lines (1), (2), (3) and (4) in this order as shown in FIG. 8) with the head face including the discharge port portions 1Aa, 1Ba to execute a cleaning operation (wiping operation). After the cleaning operation, the cleaning members 10A, 10B further move in a direction D to come into contact with cleaners 11A, 11B (represented by broken line (4)), whereby the ink droplet, dust, paper dust etc. scraped off from the head face and deposited on the cleaning members 10A, 10B are recovered by transfer to the respectively corresponding cleaners 11A, 11B. In this operation, the caps 4A, 4B of the capping means are retracted in a direction C by an unrepresented drive source to a position (not shown) not interfering with the cleaning members 10A, 10B.

In the ordinary recovery operation explained in the foregoing with reference to FIGS. 6 to 10, the pigment ink head 1A is subjected to the ink suction, cleaning and preliminary discharge by means of the cap (capping means) 4A for the pigment ink head, the ink absorbing member 9A and the cleaning member (cleaning means) 10A. Also the dye ink head 1B is subjected to the ink suction, cleaning and preliminary discharge by means of the cap (capping means) 4B for the dye ink head, the ink absorbing member 9B and the cleaning member (cleaning means) 10B.

In the following there will be explained, with reference to FIGS. 3 to 12, various embodiments of the recovery operation according to the present invention. The present invention is used for eliminating the pigment ink deposited and solidified on the capping means for the pigment ink head. In addition, these embodiments may be realized in suitable combinations, the effects of such embodiments may be further enhanced by realization in such combinations, and such combinations are also within the scope of the present invention.

(First Embodiment)

At first there will be explained, with reference to FIG. 3, a first embodiment of the recovery operation for eliminating the pigment ink deposited and solidified in the ink absorbing member 9A and in the head contact portion (contact face) of the cap 4A for the pigment ink head. For example, in a non-capped state as shown in FIG. 6, the main scanning carriage 2 is moved in the direction A from the state shown in FIG. 6 and is stopped in a position where the dye ink head 1B is opposed to the capping means 4A for the pigment ink head as shown in FIG. 3.

In such a state, there is executed preliminary discharge of the dye ink from the discharge port (discharge port portion) 1Ba of the dye ink head 1B to the ink absorbing member 9A for the pigment ink head. The discharge applies apply the dye ink to the pigment ink deposited and solidified in the ink absorbing member 9A, thereby dissolving the deposited and solidified pigment ink with the dye ink. Then, the dissolved pigment ink is eliminated, for example, by suction recovery. In such an operation where the dye ink is applied to the deposited and solidified pigment ink, there is provided a certain standby time to achieve sufficient dissolution of the pigment ink, thereby improving the ability to eliminate the pigment ink deposited and solidified in the ink absorbing member 9A.

In the above-described first embodiment, a head recovery device is provided with a pigment ink head 1A for discharging pigment ink, a dye ink head 1B for discharging dye ink, capping means 4A, 4B for sealing the discharge ports 1Aa, 1Ba of the aforementioned heads and suction means (suction pumps) 5A, 5B for providing the corresponding capping means with a predetermined negative suction pressure for sucking ink from the discharge ports. The head recovery device is constructed to execute an ordinary recovery operation by preliminary discharge from the pigment ink head 1A to the capping means 4A for the pigment ink head or unrepresented preliminary discharge receiving means and preliminary discharge from the dye ink head 1B to the capping means 4B for the dye ink head or unrepresented preliminary discharge receiving means. The head recovery device further executes a predetermined recovery operation by preliminary discharge of dye ink from the dye ink head 1B to the capping means 4A for the pigment ink head or the unrepresented preliminary discharge receiving means, wherein the pigment ink deposited and solidified in the capping means 4A for the pigment ink head or in the preliminary discharge receiving means is dissolved by the dye ink. Then, the dissolved pigment ink is eliminated by suction. In this manner, the head recovery device can easily and securely execute the recovery operation for eliminating the deposited and solidified pigment ink.

(Second Embodiment)

The foregoing first embodiment is so constructed as to execute the preliminary discharge of the dye ink toward the ink absorbing member 9A for the pigment ink head (for the pigment ink discharge port), but the preliminary discharge of the dye ink may also be executed toward the head face contact portion (discharge port face contact portion, namely a portion contacting the head face/discharge port face) of the capping means (cap) 4A for the pigment ink head. A second embodiment for executing the preliminary discharge toward the head face contact portion will be explained in the following with reference to FIGS. 4 to 8.

For example, in a non-capped state as shown in FIG. 6, the main scanning carriage 2 is moved in the direction A from the state shown in FIG. 6 and is stopped in a position where the discharge port 1Ba of the dye ink head 1B is opposed to the head face contact portion (discharge port face contact portion, namely a portion contacting the head face/discharge port face) 4Aa (cf. FIG. 4) of the cap (capping means) 4A for the pigment ink head. In such state, there is executed preliminary discharge of the dye ink from the discharge port 1Ba of the dye ink head 1B to the capping means (cap) 4A for the pigment ink head to apply the dye ink to the pigment ink deposited and solidified in the head face contact portion 4Aa. This dissolves the deposited and solidified pigment ink with the dye ink, and the recovery operation is achieved by eliminating the dissolved pigment ink.

Then the main scanning carriage 2 is moved in a direction F and is stopped in a position where the discharge port 1Ba of the dye ink head 1B is opposed to the head face contact portion 4Ab of the cap 4A for the pigment ink head. In such a state, there is executed preliminary discharge of the dye ink from the discharge port 1Ba of the dye ink head 1B to the head face contact portion 4Ab of the cap 4A for the pigment ink head to apply the dye ink to the pigment ink deposited and solidified in the head face contact portion 4Ab. This dissolves the deposited and solidified pigment ink with the dye ink, and the recovery operation is achieved by eliminating the dissolved pigment ink. In such an operation where the dye ink is applied to the deposited and solidified pigment ink, there may be provided a certain standby time to achieve sufficient dissolution of the pigment ink, thereby improving the ability to eliminate the pigment ink deposited and solidified in the head face contact portions 4Aa, 4Ab of the cap 4A for the pigment ink head.

Then, the cap 4A for the pigment ink head is moved by the unrepresented drive source in a direction D (FIG. 8), and is stopped in a position where a head face contact portion 4Ad of the cap 4A is in the area of the discharge port 1Ba of the dye ink head 1B. In such a state, there is executed preliminary discharge of the dye ink from the discharge port 1Ba of the dye ink head 1B to the head face contact portion 4Ad of the cap 4A for the pigment ink head to apply the dye ink to the pigment ink deposited and solidified in the head face contact portion 4Ad. This dissolves the deposited and solidified pigment ink with the dye ink, and the recovery operation is achieved by eliminating the dissolved pigment ink.

Then, the cap 4A is moved in a direction E and is stopped in a position where the head face contact portion 4Ac (FIG. 8) of the cap (capping means) 4A is in the area of the discharge port 1Ba of the dye ink head 1B. In such a state, there is executed preliminary discharge of the dye ink from the discharge port 1Ba of the dye ink head 1B to the head face contact portion 4Ac of the cap 4A for the pigment ink head to apply the dye ink to the pigment ink deposited and solidified in the head face contact portion 4Ac. This dissolves the deposited and solidified pigment ink with the dye ink, and the recovery operation is achieved by eliminating the dissolved pigment ink. Also in this case, in a state where the dye ink is applied to the deposited and solidified pigment ink, there may be provided a certain standby time to achieve sufficient dissolution of the pigment ink, thereby improving the ability to eliminate the pigment ink deposited and solidified in the head face contact portions 4Ac, 4Ad of the cap 4A for the pigment ink head.

(Third Embodiment)

In the following there will be explained, with reference to FIGS. 3 and 5, a third embodiment for executing suction of the dye ink head 1B with the cap (capping means) 4A for the pigment ink head and the ink absorbing member 9A thereof. For example in a non-capped state as shown in FIG. 6, the main scanning carriage 2 is moved in the direction A from the state shown in FIG. 6 and is stopped in a position where the discharge port 1Ba of the dye ink head 1B is opposed to the cap (capping means) 4A for the pigment ink head.

In such a state, as shown in FIG. 5, the cap 4A for the pigment ink head is moved by the unrepresented drive source in the direction B to cap the head face (discharge port face) of the dye ink head. In such a capped state, the suction pump (suction means) 5A for the pigment ink head is activated to execute suction. Such suction causes forced discharge of the dye ink from the discharge port 1Ba of the dye ink head 1B and applies the discharged dye ink to the pigment ink deposited and solidified in the cap absorbing member 9A for the pigment ink head and to the head face contact portion (portion contacting the head face) of the cap 4A. This dissolves the deposited and solidified pigment ink with the dye ink, and the recovery operation is achieved by eliminating the dissolved pigment ink during the suction.

In the foregoing first, second and third embodiments, the pigment ink head (pigment ink discharge port) for discharging the pigment ink is positioned closer to the recording area than the dye ink head (dye ink discharge port) for discharging the dye ink and the capping means (cap) for the pigment ink head is positioned closer to the recording area than the capping means (cap) for the dye ink head, whereby the recovery operation of the present invention can be realized by a recovery device same as that for the ordinary recovery operation, without expanding the operating range of the main scanning carriage.

(Fourth Embodiment)

In the foregoing first, second and third embodiments, the cap (capping means) 4A for the pigment ink head and the cap (capping means) 4B for the dye ink head are formed as separate members, but they may also be constructed as an integral cap. More specifically, similar results can be obtained with an integral cap having a cap chamber for the discharge port of the pigment ink head 1A and a cap chamber for the discharge port of the dye ink head 1B for forming independent closed systems. A fourth embodiment having such configuration will be explained in the following with reference to FIG. 11.

Referring to FIG. 11, an integral cap 4 is provided with a cap chamber 4*a* for the discharge port of the pigment ink head 1A and a cap chamber 4*b* for the discharge port of the dye ink head 1B. The chambers are separated by a partition 4*c* and are adapted for forming independent closed systems for the respective discharge ports. Other configurations of the present fourth embodiment are substantially the same as those in the other embodiments, and the present embodiment may be executed with the other embodiments in arbitrary combinations.

(Fifth Embodiment)

In the foregoing first, second and third embodiments, the pigment ink head 1A (pigment ink discharge port 1Aa) and the dye ink head 1B (dye ink discharge port 1Ba) are formed as separate members (or in separate members), but there may also be employed an integral head 1 having the pigment ink discharge port 1*a* and the dye ink discharge port 1*b*, as shown in FIG. 12. Effects similar to those in the foregoing embodiments can be attained in such configuration. A fifth embodiment having such configuration is shown in FIG. 12. Other configurations of the present fifth embodiment are substantially the same as those in the other embodiments, and the present embodiment may be executed with the other embodiments in arbitrary combinations.

In the foregoing embodiments, the preliminary discharge of the dye ink is executed toward the cap (capping means), but it may also be executed toward separately provided preliminary discharge receiving means (for example an ink receiving container or an ink absorbing member) with similar effects. Also in the foregoing embodiments, there has been explained a case of a serial recording apparatus in which recording is executed while the recording head (pigment ink head 1A and dye ink head 1B) constituting the recording means is moved in the main scanning direction, but the present invention is likewise applicable, with similar effects, to a line type recording system (line type recording apparatus) in which the recording is executed by sub scanning only with a line type recording head of a length covering the entire width of the recording medium or a part thereof.

Furthermore, the present invention is executable regardless of the number of the recording heads, and is applicable, with similar effects, not only to a recording apparatus employing a single recording means, but also to a recording apparatus employing plural recording means, a gradation recording apparatus employing plural recording means for recording a same color with different densities and a recording apparatus utilizing a combination of the foregoing. Furthermore, the present invention is applicable, with similar effects, to any configuration of the recording head and the ink tank, such as a configuration employing an exchangeable head cartridge in which the recording head and the ink tank are integrated or a configuration in which the recording head and the ink tank are formed to be separate and connected by an ink supply tube.

Within the ink jet recording apparatus, the present invention is applicable to an apparatus employing recording means based on an electromechanical converting member, such as a piezoelectric element, but it brings about excellent effects in an ink jet recording apparatus employing recording means of a type utilizing thermal energy for ink discharge, since such a type can achieve recording of high density and high definition.

(Sixth Embodiment)

Figure 15:
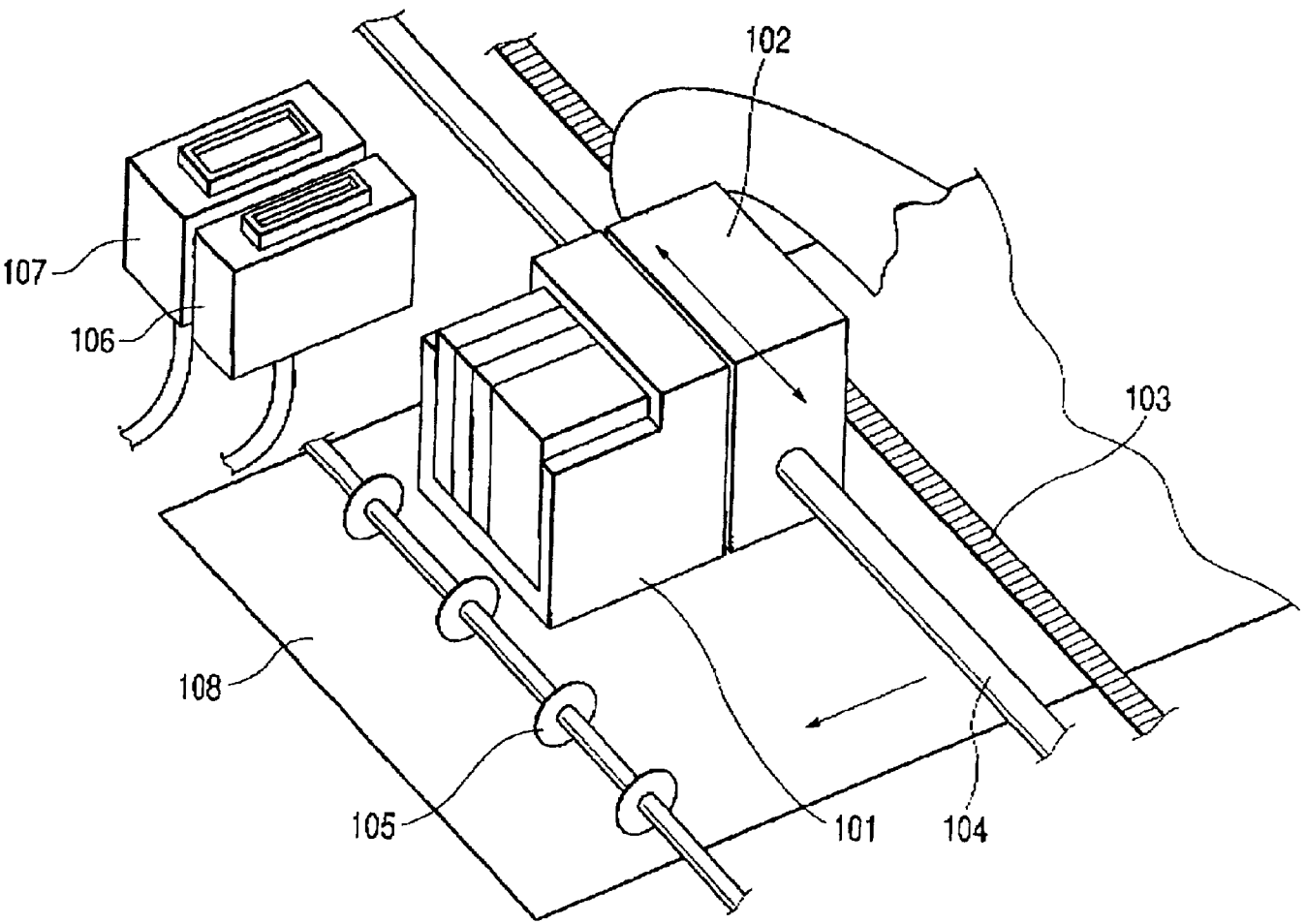
FIG. 15 is a schematic perspective view showing the configuration of a sixth embodiment of the ink jet recording apparatus of the present invention.

FIG. 15 is a schematic perspective view showing the configuration of a sixth embodiment of the ink jet recording apparatus of the present invention, wherein a recording head cartridge 101 constituting the recording means is replaceable mounted on a carriage 102 which is so supported as to be capable of reciprocating motion across a recording sheet 108 constituting the recording medium. Also, instead of the illustrated recording head cartridge 101, there may be employed recording means (recording head cartridge or the like) directly fixed to the carriage 102. The carriage 102 is supported so as to be capable of reciprocating motion along a guide shaft 104 provided in the main body of the apparatus, and a drive belt 103 is connected to the carriage 102.

During the recording operation, recording is executed on a recording sheet 108 by activating the recording head cartridge 101 according to recording information, while moving the carriage 102 along the guide shaft 104 by means of the drive belt 103 and an unrepresented motor. After the recording of a line during the movement (main scanning) of the carriage 102, the recording sheet 108 is conveyed by a predetermined pitch (sub scanning) by the conveying means, and the recording of a next line is executed. The recording is made on the entire recording sheet 108 by repeating such recording of a line and sheet conveying by the predetermined pitch.

In the present embodiment, the recording head cartridge 101 is provided with plural groups of discharge ports for the inks of respective colors, such as those for black ink, those for cyan ink, those for magenta ink and those for yellow ink. By receiving recording signals through electrical connections with unrepresented recording signal generating means, ink droplets are discharged from the groups of discharge ports for the corresponding colors in the recording head cartridge 101 to form an image on the recording sheet 108. In the present embodiment, ink tanks (for example, tanks 113 to 116 shown in FIG. 16) are detachably (replaceably) mounted in the recording head cartridge 101 constituting the recording means, and an ink tank of a kind (for example color) can be adjoined to each group of the discharge ports. The ink supply means is not limited to the aforementioned system of directly adjoining the ink tank to the recording head cartridge, but can also be composed of a system of supplying the ink from an ink tank provided in the recording apparatus through a flexible tube or the like.

The aforementioned recording head cartridge 101 constituting the recording means is an ink jet recording head utilizing thermal energy for ink discharge and is provided with an electrothermal converting member for generating thermal energy. Such an ink jet recording head executes recording by inducing film boiling in the ink by the thermal energy applied by the electrothermal converting member, and discharges ink from the discharge port utilizing a pressure change resulting from the growth and contraction of a bubble generated by such film boiling. The ink discharge portion of the recording means (recording head) 101 has the structure as explained in the foregoing with reference to FIG. 2.

At the execution of recording, the recording signals are received from the unrepresented recording signal generating means as explained in the foregoing, and the recording head cartridge 101 forms an image on the recording sheet 108. In such operation, even in the course of recording, preliminary discharge of a predetermined amount is executed into caps 106, 107 at a predetermined interval in order to prevent drying of the discharge ports not used for ink discharge. The predetermined interval for the preliminary discharge is preferably changed depending on the ambient temperature, the temperature and status of the recording head cartridge, and discharges of 15 to 20 ink droplets are usually executed from all the discharge ports at an interval of 5 to 10 seconds.

In the ordinary recording operation, the preliminary discharge from the group of the black discharge ports is executed into the cap 106 for black color, and that from the groups of color discharge ports for cyan, magenta and yellow colors is executed into the color cap 107. The ink retained in the cap, upon reaching a predetermined amount, is discharged by an idle suction operation executed by the pump. The idle suction operation is a suction operation executed in a state where the cap is not contacted with the recording head cartridge, so that the ink is not discharged from the discharge ports.

In capping the recording head after the recording operation, a defect may be generated in the black discharge ports of the recording head cartridge when ink of a predetermined amount was preliminarily discharged into the cap prior to such capping and the recording head cartridge was left standing for a prolonged period in such a capped state. Such a phenomenon is due to the behavior of the pigment-based ink, employed as the black ink, different from that of the conventional dye-based ink.

The black pigment-based ink is excellent in image sharpness (image quality), recording density, light fastness and moisture resistance, but is difficult to re-dissolve once the ink is dried. For this reason, the black ink remaining in the cap for a prolonged period may show viscosity increase or solidification, thereby hindering the proper sucking operation of the pump. Such a drawback can, however, be significantly alleviated by executing the ink discharge into the cap prior to prolonged standing with the dye-based ink (namely color ink) instead of the pigment-based ink.

The present invention operates by separating the preliminary discharge operation in the course of the recording operation and that prior to the capping operation after the recording operation, and by retaining in the cap ink different from the ink employed in the corresponding recording means (for example the recording head cartridge 101). More specifically, in the black discharge port, at first the pigment-based black ink present in the cap is discharged to the exterior by idle suction operation by the pump, then dye-based color ink is discharged by a predetermined amount from the color discharge port into the black cap in order to prevent water evaporation from the black discharge port, and the capping operation is executed on the black discharge port. On the other hand, in the color discharge port, the color ink of a predetermined amount is discharged into the corresponding cap and then the capping operation is executed on the color discharge port. The pigment-based black ink and the dye-based color ink are so selected that they are not mutually reactive, so that viscosity increase or solidication will not result even when both inks are mixed.

Figure 16:
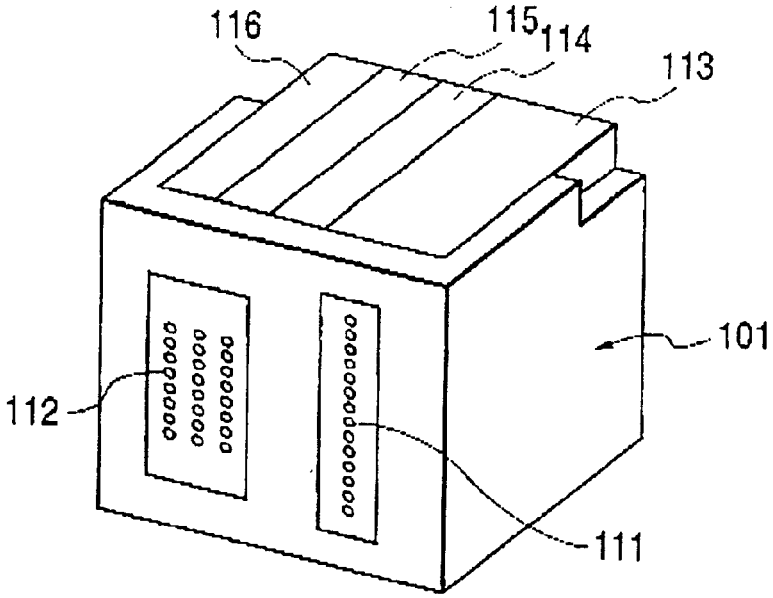
FIG. 16 is a schematic perspective view showing an example of the configuration of a recording head cartridge constituting the recording means in FIG. 15.

FIG. 16 is a schematic perspective view showing an example of the configuration of the recording head cartridge 101 constituting the recording means in FIG. 15. Referring to FIG. 16, the recording head cartridge 101 is provided with a discharge port group 111 for the black ink and discharge port groups 112 for the color inks on a common (same) discharge port face in integral manner. For the aforementioned color inks, there are provided discharge port groups for three inks of cyan, magenta and yellow. The present embodiment shows an example of recording with inks of four colors, but the kinds of the inks to be used are not limited by such example and there may also be provided discharge port groups for the inks including for example photo cyan, photo magenta and photo yellow, or those for the inks including for example dark cyan, dark magenta and dark yellow.

For each discharge port group there is provided an individual ink tank (black tank 113, cyan tank 114, magenta tank 115 or yellow tank 116), which is detachably mounted on the recording head cartridge 101 so as to be connected with the corresponding discharge port group. Each ink tank is replaced by the user when the ink therein is used up. The black ink tank 113 contains pigment-based black ink utilizing for example carbon black as explained in the foregoing. In monochromatic recording, there are required recording density, water fastness and light resistance on the plain paper, and the pigment-based ink is becoming principally used in the recent ink jet recording means.

On the other hand, for the color inks, the dye-based inks are principally used because the color development is considered important. In recording a photographic image, the photographic quality can be realized by employing glossy paper or glossy film. Such glossy media (recording media) incorporate the excellent performances such as water fastness and light resistance in the recording media themselves, and exhibit such excellent performances by reaction or matching with the ink.

In the recording head cartridge 101 shown in FIG. 16, the black tank 113 and the color tanks 114 to 116 contain therein a porous absorbent member composed for example of polyurethane foam or an absorbent member formed by compressing or thermally fixing polyester fibers or polypropylene fibers, but they may also be formed by an aluminum bag directly containing ink, and the structure of the ink tank is not particularly restrictive in the execution of the present invention.

When the ink in the ink tank is exhausted, the tank is replaced to restore the full state. The remaining amount of the ink may be detected by a known optical detection method or a dot count method of counting the number of the discharged dots and the timing of replacement is informed to the user for executing ink replenishment.

Figure 17A:
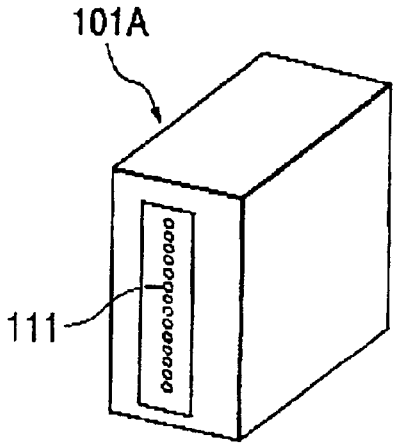
FIGS. 17A and 17B are schematic perspective views showing other examples of the configuration of the recording head cartridge constituting the recording means in FIG. 15.
Figure 17B:
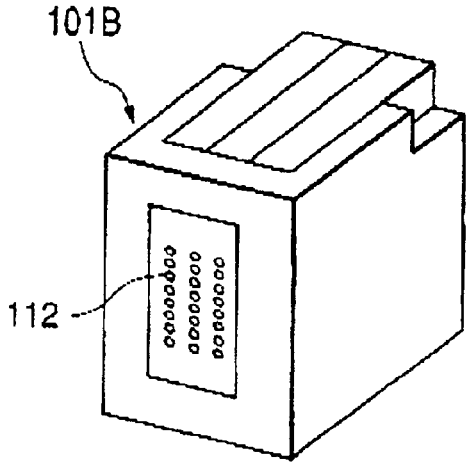

FIGS. 17A and 17B are schematic perspective views showing other examples of the configuration of the recording head cartridge 101 constituting the recording means in FIG. 15. In the recording head cartridge 101 shown in FIGS. 17A and 17B, a black recording head 101A and a color recording head 101B are constructed separately. The black recording head 101A is provided with a black discharge port group 111, while the color recording head 101B is provided with a color discharge port group 112. The black recording head 101A is integrally constructed with the ink tank, but, in the color recording head 101B, the ink tanks of respective colors are formed separately and rendered individually replaceable.

Figure 18:
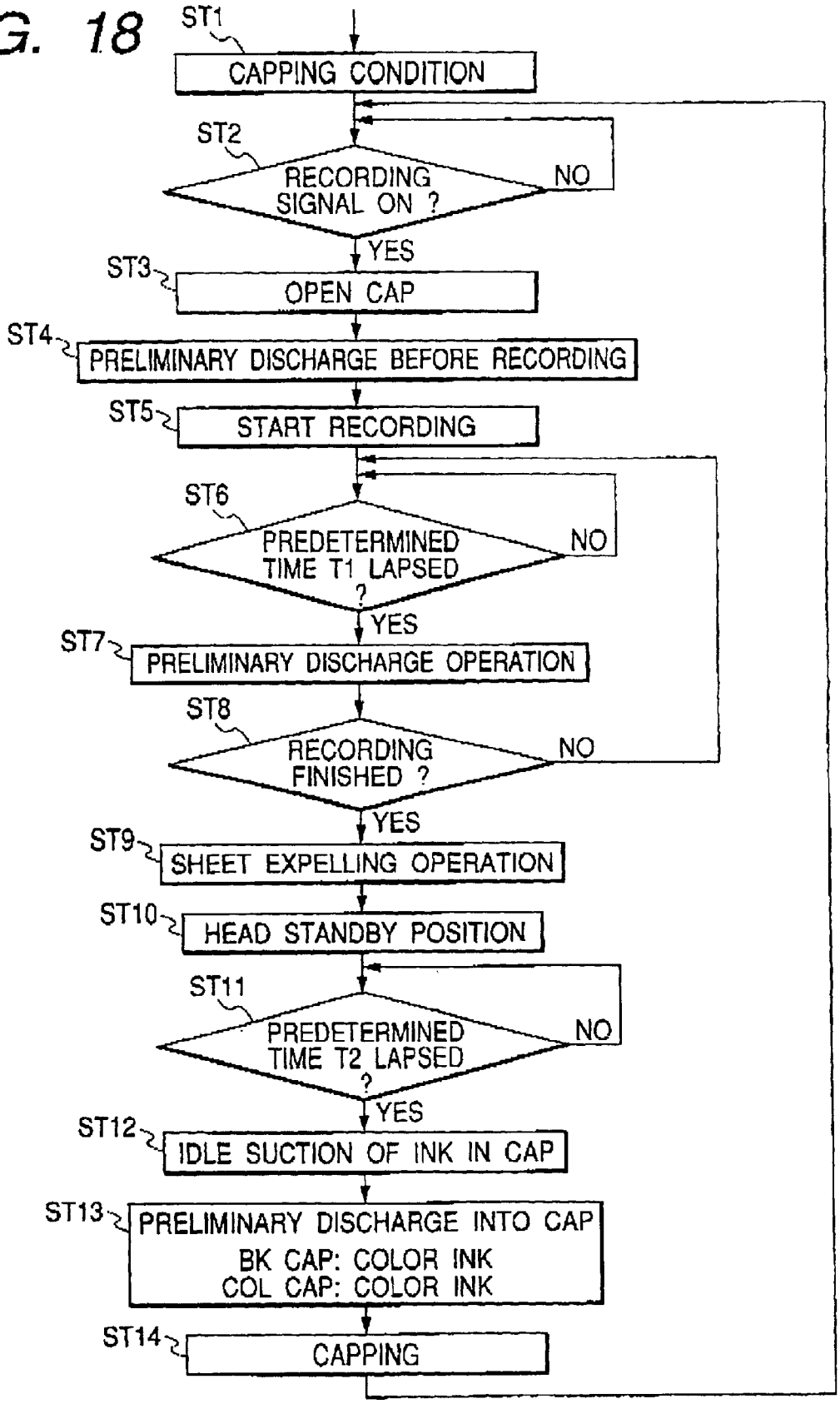
FIG. 18 is a flow chart showing the operation sequence of the sixth embodiment of the ink jet recording apparatus of the present invention.

FIG. 18 is a flow chart showing the operation sequence of a sixth embodiment of the ink jet recording apparatus embodying the present invention. Referring to FIG. 18, when the power supply is turned on, the recording means is usually in a capped state after the execution of an initializing operation. In the following the operations will be explained by each step (ST). A step ST1 is a capped standby state, and a step ST2 confirms the presence of input of a recording signal. If a recording signal is entered, a step ST3 opens the cap, and a step ST4 executes a pre-recording preliminary discharge of discharging ink of a predetermined amount into the respective cap for the maintenance of the recording means (recording head) prior to recording. If the standby state is relatively long, it is desirable to execute a suction operation from the recording head through the cap, thereby discharging old ink from the discharge ports, prior to the start of the recording operation.

After the execution of the aforementioned head maintenance prior to the recording, a step ST5 starts recording, thereby forming an image. A step ST6 determines if a predetermined time T1 for preventing drying of the discharge ports not used in the recording has elapsed, and whether the periodic discharging of viscosified ink from the recording head into the cap is needed. More specifically, the preliminary discharge is desirably executed with an interval of 5 to 15 seconds in the course of the recording operation, and such interval is appropriately selected by detecting the ambient temperature or the recording head temperature. A step ST7 discharges 10 to 20 droplets in performing a preliminary discharge operation. The content of such preliminary discharge is variable depending on the ink property, and it is desirable to change the number of discharged droplets depending on the volume of each discharged droplet.

A step ST8 determines whether the recording operation is completed, and, if completed, a step ST9 executes a sheet discharging (expelling) operation. If not completed, the sequence returns to the step ST6 for repeating the above-described operations. After the sheet discharging operation in the step ST9, a step ST10 causes the recording head to wait in a position adjacent to the cap for a certain period after the completion of recording, in order to wait for a next recording signal. A step ST11 determines whether the time elapsing after the recording head is put into the standby state in the step ST10 has exceeded a predetermined time T2 and, if the next recording signal is not received before the lapse of the predetermined time T2, the sequence proceeds to the following capping operation after the completion of the recording. The predetermined time T2, in the step ST11, is selected, for example, as about 1 to 2 minutes.

In the capping operation after the completion of recording, at first a step S12 executes an idle suction operation of sucking the interior of each cap to a negative pressure by the suction pump, thereby discharging the ink discharged into the cap in the course of the recording operation. Such idle suction operation is a process prior to the capping. Then a step ST13 executes an ink discharge operation (preliminary discharge) in order to maintain the interior of the cap in a moist state, in consideration of a situation where the recording head is jet to stand for a considerably long period in the capped state. Such ink discharge operation is executed in such a condition that the ink discharged into the cap does not show viscosity increase nor solidification. More specifically, at first the dye-based color ink of a predetermined amount is discharged to the ink absorbing member provided in the black cap. Then the dye-based color ink of a predetermined amount is discharged to the ink absorbing member provided in the color cap.

The aforementioned ink absorbing member is preferably composed of a porous member such as hydrophilically treated polyurethane or polyethylene foam, but such materials are not restrictive and there can be employed absorbent members of various materials and structures as long as a certain ink retaining ability is obtained. Then a step ST14 presses the cap to the recording means to attain a capped state, whereby the operation sequence is terminated.

The operation sequence shown in FIG. 18 maintains the discharge ports and the vicinity thereof of the recording means (recording head) even in case of a prolonged standing, thereby preventing viscosity increase or solidification of the ink in the cap when the recording operation is re-started after such standing. Also, even in the case of defective ink discharge resulting, for examples, from the clogging of the discharge port of the recording head cartridge (recording means) in the course of the prolonged standing, the ink discharge ability of the recording means (recording head cartridge) can be easily restored by executing a suction recovery operation of sucking the ink from the discharge port by the suction pump.

In the following there, will be explained examples of the inks to be employed in the ink jet recording apparatus. The black ink can be composed of pigment-based ink employing pigment carbon black rendered dispensable by a hydrophilic treatment. There may also be employed ink that has been carbon stabilized by microencapsulation or by resin dispersion. Also, the dye to be employed in the color ink can be composed of a water-soluble dye, such as an edible dye, an acidic dye, a direct dye or a basic dye. Also, the solvent of the ink can be composed of a moisture-retaining component, such as glycerin, urea or diethylene glycol dissolved in purified water containing ethanol or isopropyl alcohol. In such case, the content of glycerin is preferably within a range of 2 to 15 wt. %, preferably 5 to 10 wt. %.

Figure 19:
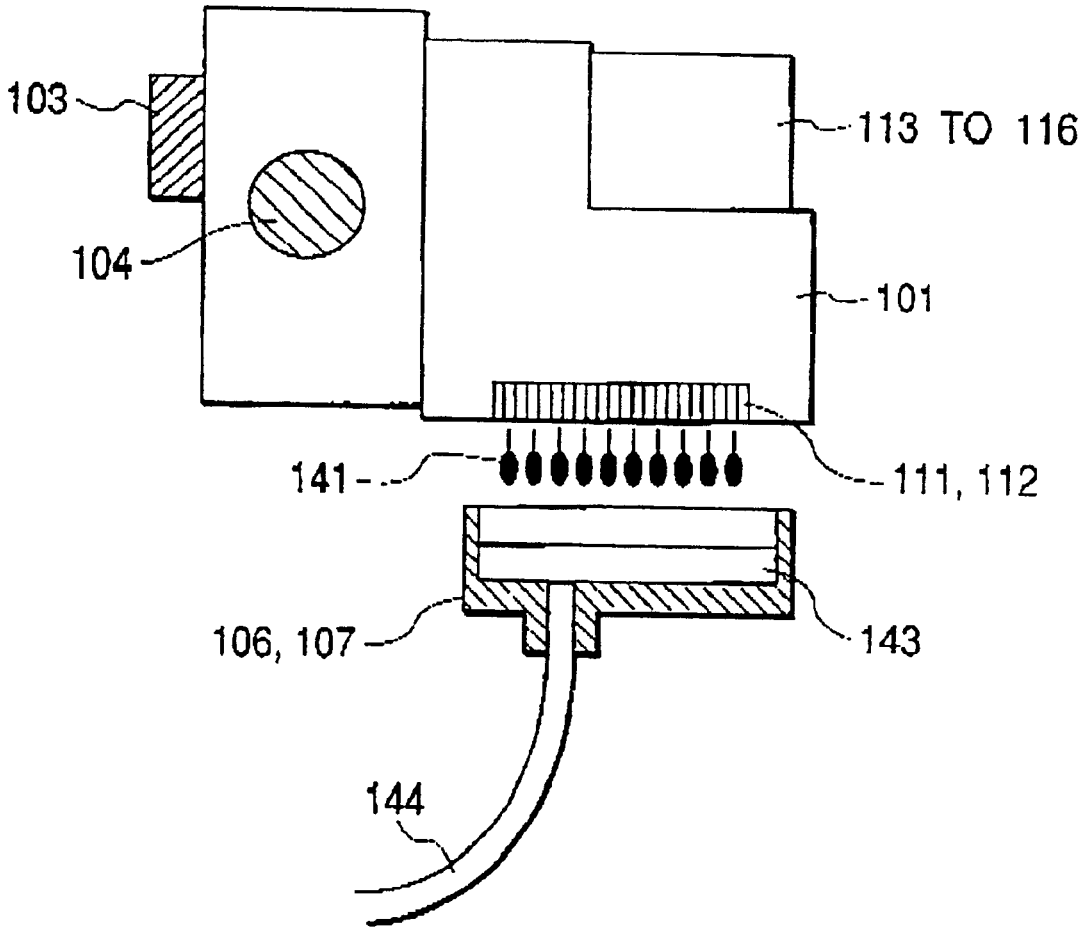
FIG. 19 is a schematic lateral cross-sectional view showing a state of ink discharge from the recording means shown in FIG. 15 into the cap.

FIG. 19 is a schematic lateral cross-sectional view showing a state of ink discharging from the recording means (recording head) shown in FIG. 15 to the cap. After the recording, the recording head cartridge 1, constituting the recording means, moves to a position opposed to the capping means provided outside the recording range. In this state, prior to the capping operation, the ink is discharged from the recording head cartridge 101 to the ink absorbing member 143 in the cap 106 (or 107). There are also shown the discharged ink (ink droplet) 141 and a suction tube 144 for connecting the cap 106 (107) to the unrepresented suction pump.

Table 1 shows the test results when the interior of the cap was maintained in a moist state with the pigment-based ink and with the dye-based ink (color ink) under a high temperature/low humidity environment. The environment was set at 30° C./RH 10% and the capped state was maintained for 40 days. In the suction recovery sequence of the recording head itself, the automatic suction operation is executed once at the re-start of recording after standing for 5 days. In the test under such conditions, the head maintained in the moist state with the pigment-based ink showed discharge failure, though in a small part of the discharge ports, at a standing period of about 10 days. The normal state was restored by the execution of the manual suction operation. Such drawback does not appear in the actual commercial products since the recording operation is started after automatic execution of the recovery operation in case the standing period exceeds 5 days.

However, the number of the discharge ports showing the discharge failure increased at a standing period of about 20 days and the normal state could be restored only after the execution of one or two manual suction operations. Also, the suction operation itself was affected by the substance of the pigment with increased viscosity, whereby the ability of recovery was deteriorated. Also, such tendency of deterioration was gradually enhanced in case of standing for 30 or 40 days, requiring the manual recovery operation to be performed 2 to 4 times.

On the other hand, in the case of executing the preliminary discharge with the dye-based ink into the black cap prior to the capping operation after the end of the recording operation, the recording head could be maintained in the normal state even after a standing for 40 days. However, an automatic recovery operation is executed after a standing for 5 days as explained in the foregoing, and a sufficient effect could be obtained with such single recovery operation. In this manner, the ink discharge ability after the standing period was evidently different depending on the kind of the ink (pigment-based ink or dye-based ink) applied to the ink absorbing member in the cap.

TABLE 1

| | Recovery in 40-day standing under environment of 30° C./RH 10% | |
|---|---|---|
| | Black pigment ink | Color dye ink |
| 1 day | A | A |
| 5 days | A | A |
| 10 days | A–B | A |
| 20 days | B | A |
| 30 days | B | A |
| 40 days | B–C | A |

wherein A: satisfactory, B: fair, C: poor (Seventh Embodiment)

Figure 20:
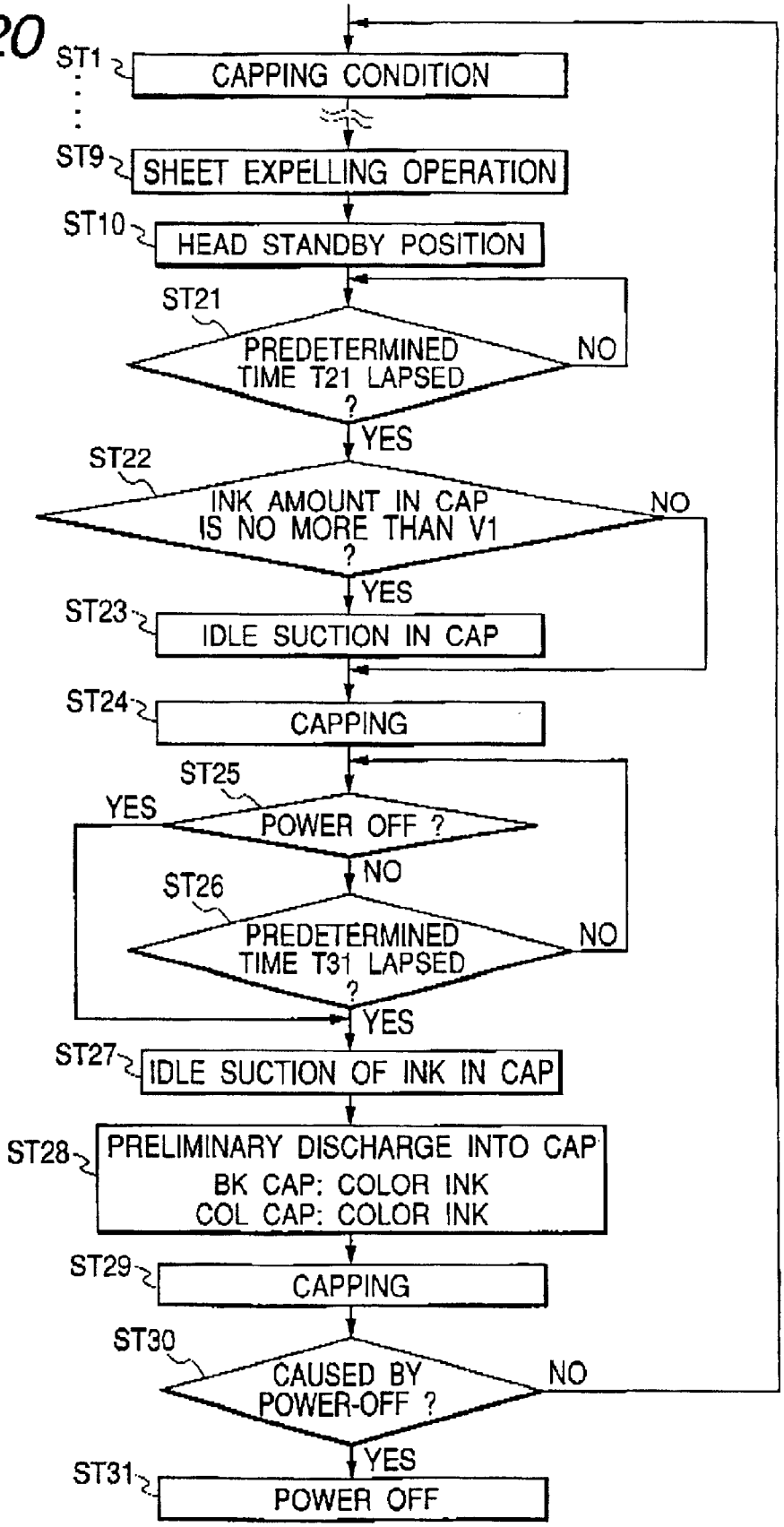
FIG. 20 is a flow chart showing the operation sequence of a seventh embodiment of the ink jet recording apparatus of the present invention.

In the following, there will be explained a seventh embodiment of the ink jet recording apparatus of the present invention. In comparison with the sixth embodiment, the seventh embodiment is different in the preliminary discharge to be executed prior to the capping operation after the recording operation. FIG. 20 is a flow chart showing the operation sequence of the seventh embodiment, wherein the operations from the capped state in the step ST1 to the standby state of the recording head in the position adjacent to the cap in the step ST10 are the same as those in the sixth embodiment shown in FIG. 18.

Referring to FIG. 20, a step ST21 manages the lapse of the standby time of the recording head in the standby position in the step ST10, and, if the standby time exceeds a predetermined time T21, a step ST22 determines the amount of ink discharged in each cap in the course of the recording operation. If the cap contains an amount of ink causing overflow of the ink, a step ST23 executes an idle suction operation and then a step ST24 presses the cap to the recording means, thereby attaining the capped state.

In the present embodiment, in case the recording signal is not received even after a prolonged period or in case the power switch is turned off in the capped state in the step ST24, there is executed a process (ST24 to ST28) of removing the pigment-based black ink in the black cap by an idle suction and discharging a predetermined amount of the dye-based color ink into the black cap.

More specifically, in case a step ST25 identifies that the user has turned off the power supply or a step ST26 identifies that a prolonged standing exceeds a predetermined time T31, a step ST27 executes a process of removing the ink contained in the cap by an idle suction operation. The above-mentioned predetermined time T31 is desirably selected within a range from several hours to about 1 day, but such range is not restrictive and the time may be suitably selected in consideration of the tendency of viscosity increase of the ink in the cap. In the idle suction of the ink in the cap in the step ST27, the pigment-based black contained in the black cap and the dye-based color ink contained in the color cap are removed by the idle suction of the suction pump.

A step ST28 discharges the ink (dye-based color ink) of a predetermined amount into all the caps, namely the black cap and the color cap, from the color recording head. More specifically, the dye-based ink is discharged by several hundred droplets to several thousand droplets. In the present embodiment, there was employed a discharge of 2000 droplets, but the number of droplets is preferably determined in consideration of the discharge amount per droplet from the discharge port of the color recording head. The step ST29 presses the cap to the recording means, thereby attaining the capped state, Then a step ST30 determines whether the continuation of the capped state of the recording means is due to the turning off of the power supply, and, if so, the sequence proceeds to a step S31 to turn off of the power supply, thereby terminating the sequence. On the other hand, if it is not due to the turning off of the power supply, the sequence returns to the step ST1 to repeat the above-described sequence.

Also, in the seventh embodiment explained in FIG. 20, as in the aforementioned sixth embodiment, there is at first an idle suction operation for discharging by suction the ink discharged into the respective caps, in the course of the recording operation, prior to the capping operation after the recording operation. Then there is executed a preliminary discharge (ink discharge) operation of discharging the dye-based ink (color ink) into the cap in order to maintain the interior thereof. In the moist state in consideration of a fact that the recording head may be let to stand in the capped state over a considerably long period.

Also, in the seventh embodiment having the operation sequence as shown in FIG. 20, it is rendered possible to maintain the discharge port and the vicinity thereof of the recording means (recording head) even in case of a prolonged standing, thereby preventing viscosity increase or solidification of the Ink in the cap when the recording is re-started after such standing. Also, even if an ink discharge failure occurs, for example, by the clogging of the discharge port of the recording head cartridge (recording means) by prolonged standing, the ink discharge ability of the recording means (recording head cartridge) can be easily restored by executing a suction recovery operation of activating the suction pump and sucking the ink from the discharge port.

(Eighth Embodiment)

Figure 21:
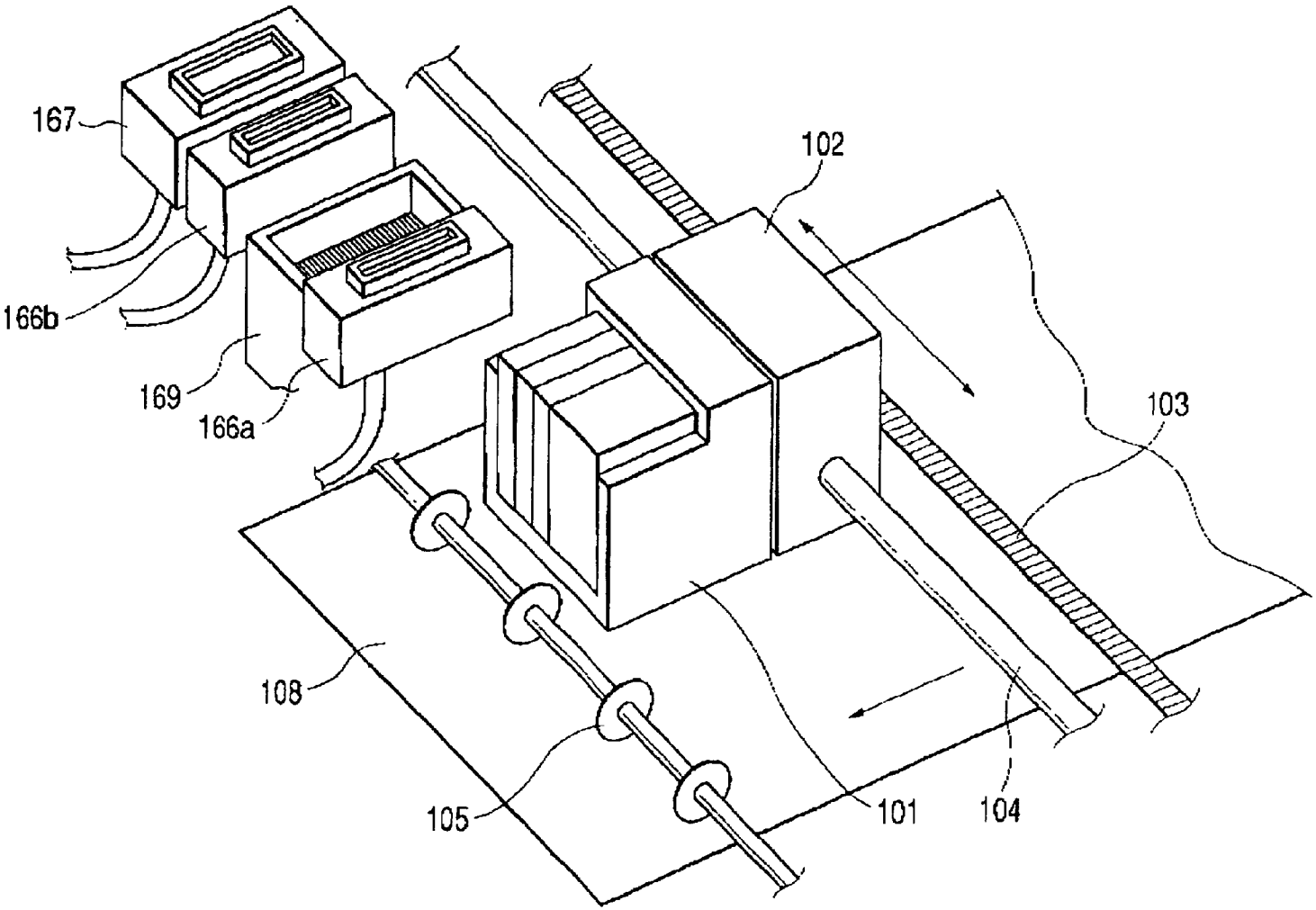
FIG. 21 is a schematic perspective view showing the configuration of an eighth embodiment of the ink jet recording apparatus of the present invention.

In the following there will be explained an eighth embodiment of the ink jet recording apparatus of the present invention. FIG. 21 is a schematic perspective view showing the configuration of the eighth embodiment of the ink jet recording apparatus of the present invention, wherein two caps are provided for the black recording means. A cap 166*a* is used for executing a periodical preliminary discharge operation for preventing the drying of the discharge port not used in the recording operation (not used for ink discharge), and is connected with an unrepresented suction pump for suction from the black recording means. On the other hand, a black cap 166*b* is a protection cap for the black recording means in the standing state. A preliminary discharge receiving portion 169 is used for executing a periodical preliminary discharge operation from the color recording means for preventing drying in the course of the recording operation.

The preliminary discharge cap 166*a* for receiving the preliminary discharge exclusively for black ink and the black cap 166*b* exclusively for standing are separated because there is employed an ink system in which the pigment-based black ink and the dye-based color ink are mutually reactive. More specifically, there are employed pigment-based anionic black ink and dye-based cationic color ink to avoid mutual bleeding of the inks in a portion where a black image area and a color image area are mutually adjacent. In a portion where both inks are mutually adjacent on the recording sheet, the bleeding phenomenon can be prevented by the mutual reaction of the inks. Such reaction may also be induced by color ink containing a divalent metal salt, and the pigment-based black ink and the dye-based color ink show viscosity increase or solidification by the reaction.

In the periodical preliminary discharge operation in the course of the recording operation, there is executed a preliminary discharge of discharging 10 to 20 ink droplets from all the discharge ports at an interval of 10 to 15 seconds. The periodical ink discharge is not executed into the black protecting cap 166*b* or the color cap 167. However, prior to the capping operation after the end of the recording operation, the dye-based ink of a predetermined amount is discharged from the color recording head into the black protection cap 166*b* and the color cap 167 and the capped state is attained thereafter by pressing the cap to the recording head as in the foregoing sixth and seventh embodiments. Also, other configurations of the eighth embodiment are substantially the same as those in the aforementioned sixth and seventh embodiments.

Figure 22:
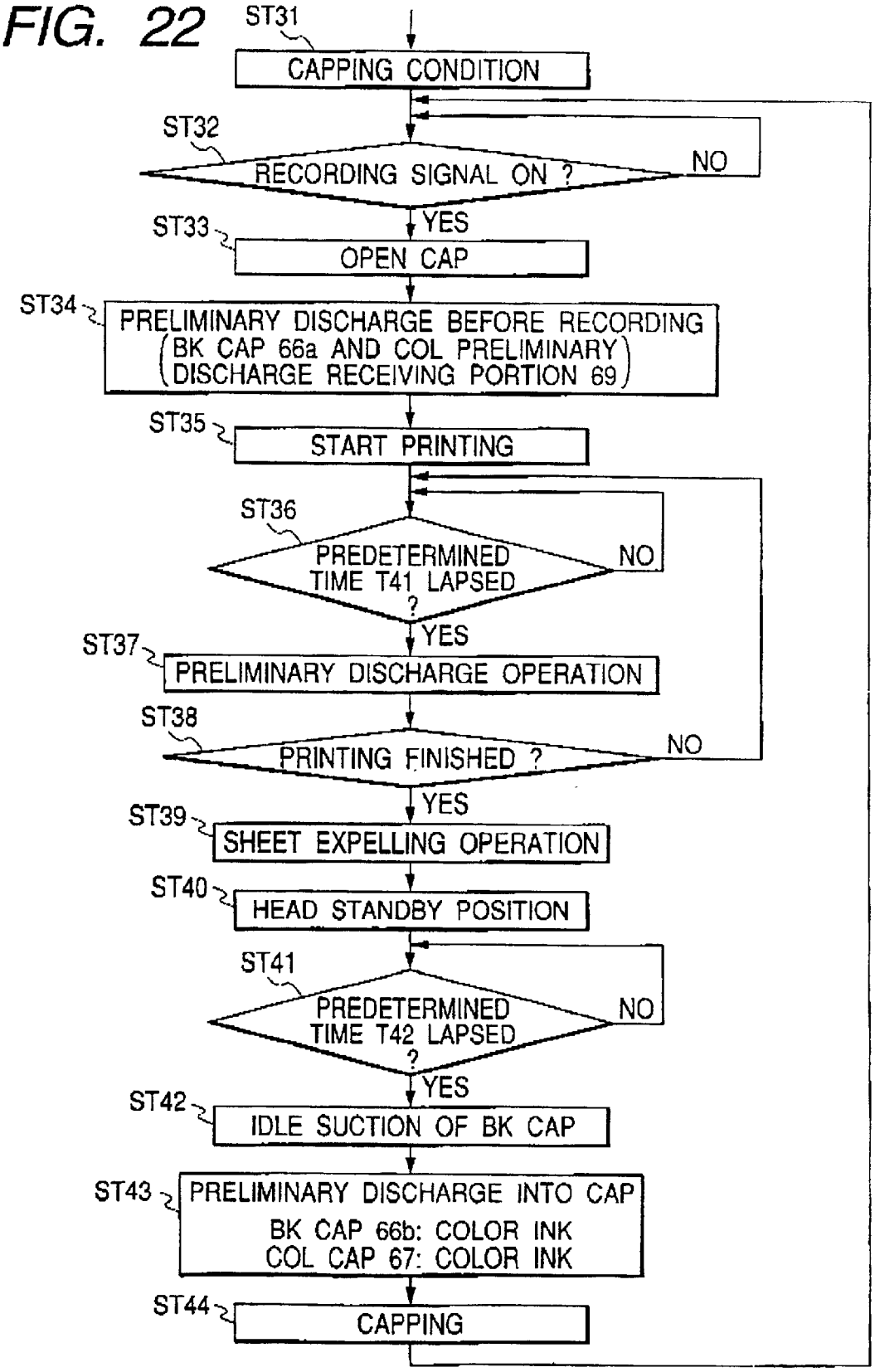
FIG. 22 is a flow chart showing the operation sequence of the eighth embodiment of the ink jet recording apparatus of the present invention.

FIG. 22 is a flow chart showing the operation sequence of the eighth embodiment of the ink jet recording apparatus embodying the present invention. Referring to FIG. 22, when the power supply is turned on, the recording means is usually in a capped state after the execution of an initializing operation. In the following, the operations will be explained by each step (ST). A step ST31 is a capped standby state, and a step ST32 confirms the input of a recording signal. If a recording signal is entered, a step ST33 opens the cap, and a step ST34 executes a pre-recording preliminary discharge of discharging ink of a predetermined amount from all the discharge ports, for the initial maintenance of the recording means (recording head) prior to the recording. More specifically, ink is discharged from the black recording means into the black cap 166*a* and from the color recording means into the preliminary discharge receiving portion 169. If the standby state is relatively long, it is desirable to execute a suction operation from the recording head through the cap, thereby discharging old ink from the discharge ports, prior to the start of the recording operation.

Then, a step ST35 starts recording, thereby forming an image. A step ST36 moves the recording head to the preliminary discharge receiving portion 169 at every predetermined time T41 in the course of the recording operation, and a step ST37 executes ink discharge (preliminary discharge) of a predetermined amount to the preliminary discharge receiving portion 169. A step ST38 determines whether the recording operation is completed, and, if completed, a step ST39 executes a sheet discharging operation. If not completed, the sequence returns to the step ST36 for repeating the above-described operations. After the sheet discharging operation in the step ST39 a step ST40 moves the recording head to a standby position for restarting the recording and awaits the recording signal.

A step ST41 determines whether the time elapsing after the recording head is put into the standby state in the step ST40 has exceeded a predetermined time T42, and, after the lapse of two minutes beyond the predetermined time T42, a step ST42 removes the ink contained in the black cap 166*a* by an idle suction operation prior to the preliminary discharge. Then, a step ST43 executes a preliminary discharge for maintaining the absorbent member in the cap in the moist state, achieved by discharging the dye-based ink (color ink) from the discharge ports of the color recording head in succession into the black protection cap 166*b* and into the color cap 167. The preliminary discharge for maintaining the moist state is not limited to the color ink of a particular color, but may be executed with the color ink of an arbitrary color or with the color inks of all the colors, or with the color ink of at least one of cyan, magenta, yellow, pale cyan, pale magenta and pale yellow. However the total amount of the ink discharged from the color discharge ports is appropriately selected in advance so as not to cause ink overflow from the cap.

Also, in the present eighth embodiment, it is preferable to execute an idle suction operation for discharging the ink already contained in the black protection cap 166*b* and in the color cap 167 prior to the aforementioned preliminary discharge operation to the absorbent members in the caps in the step ST42. Since it is desirable to remove the ink for maintaining the moist state, the ink is discharged in the preliminary discharge before the preceding capping operation. Such idle suction operation may be executed, instead of prior to the capping operation, prior to the start of recording in the step ST35 or in a standby period not used for recording. Also, if a suction recovery operation is executed before the capping operation for the recording head, the above-mentioned idle suction operation may be dispensed with because the ink with increased viscosity in the cap is already removed. Thereafter a step ST44 executes the capping of the recording head to attain a capped state whereby the sequence is terminated.

(Ninth Embodiment)

Figure 23:
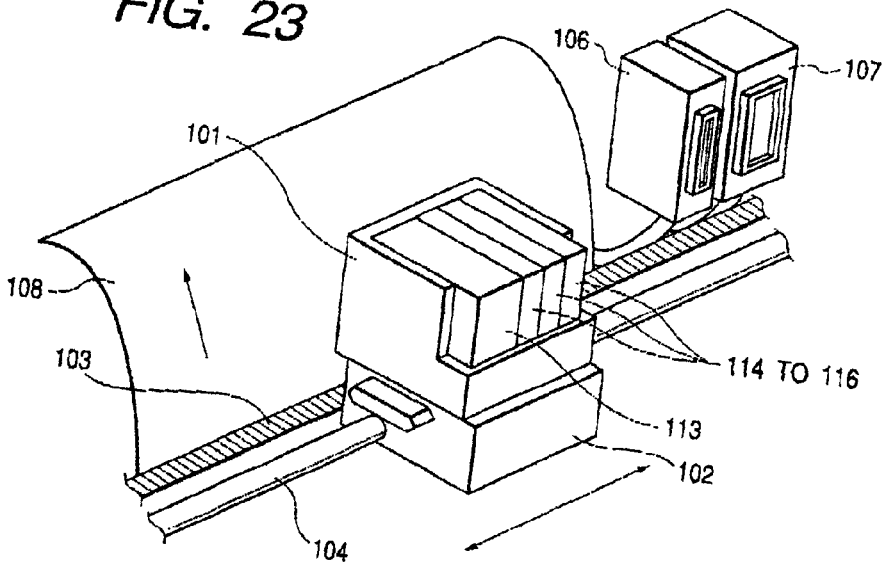
FIG. 23 is a schematic perspective view, seen from front, of a ninth embodiment of the ink jet recording apparatus of the present invention.
Figure 24:
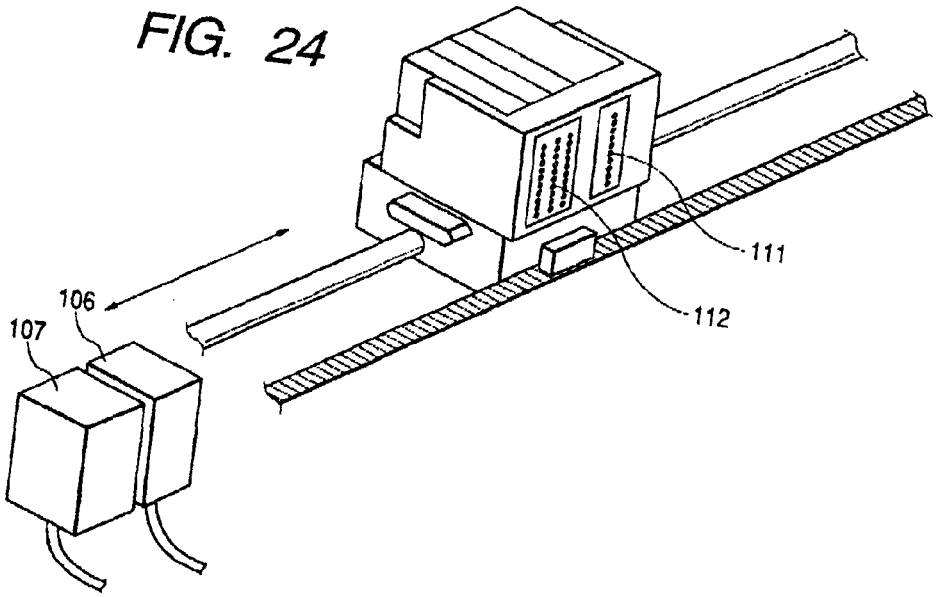
FIG. 24 is a schematic perspective view, seen from rear, of the ink jet recording apparatus shown in FIG. 23.
Figure 25:
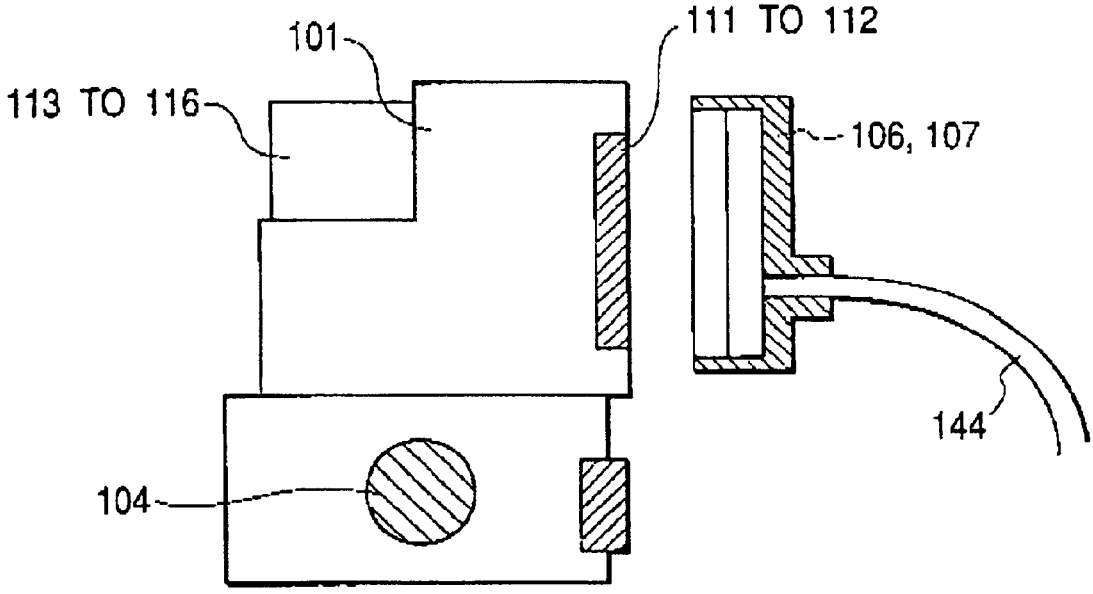
FIG. 25 is a schematic lateral cross-sectional view of the ink jet recording apparatus shown in FIG. 23.

FIG. 23 is a schematic perspective view of a ninth embodiment of the ink jet recording apparatus of the present invention seen from front, FIG. 24 is a schematic perspective view of the apparatus shown in FIG. 23 seen from rear, and FIG. 25 is a schematic lateral cross-sectional view of the apparatus shown in FIG. 23. Referring to FIGS. 23 to 25, a recording head cartridge 101, constituting the recording means, is mounted on a carriage 102 in a vertical (standing) position so as to form an image on a vertically conveyed recording sheet 108. The basic configuration of the ink jet recording apparatus shown in FIGS. 23 to 25 is the same as that of the aforementioned sixth embodiment. In the present embodiment, the recording sheet 108, constituting the recording medium, is conveyed from below to above by a predetermined pitch, and the recording is made by a line within an interval between such conveying.

Also, in the ink jet recording apparatus shown in FIGS. 23 to 25, there are adopted a configuration and an operation sequence similar to those explained in the foregoing sixth to eighth embodiments. The sequence executes preliminary discharge of the dye-based ink of a predetermined amount from the recording head into a cap (black cap) for the recording head utilizing the pigment-based ink and a cap (color cap) for the recording head utilizing the dye-based ink. This occurs prior to the capping operation, but after the recording operation. The capping operation includes pressing the recording heads to the caps, thereby preventing drying of the discharge ports. Thus, the ink jet recording apparatus shown in FIGS. 23 to 25 is different from the foregoing embodiments in that the recording head (recording head cartridge) 101 is used in the standing position to record on the recording medium 108 conveyed from below to above, but is substantially same as the foregoing embodiment in other configurations and in the operations.

In the embodiments described in the foregoing, an ink jet recording apparatus is provided with an ink jet recording head (head cartridge) 101, constituting recording means, for forming a recording on a recording sheet by discharging ink droplets from discharge ports, caps 106, 107 for preventing drying of discharge ports 111, 112 of the recording head 101 and discharge recovery means for resolving discharge failure by opposing the recording head 101 to the caps 106, 107 in a non-recording state and discharging ink droplets from the discharge ports 111, 112. The discharge recovery means discharges ink of a predetermined amount from the recording head 101 into the caps 106, 107 prior to the capping of the recording head with the caps 106, 107, but after the recording operation with the recording head 101. Dye-based ink of a predetermined amount is discharged into all the caps, namely into the cap 106 corresponding to the discharge port 111 for discharging the pigment-based ink (black ink) and into the cap 107 corresponding to the discharge port 112 for discharging the dye-based ink (color ink). The capping of the recording head is thereafter executed. In this manner, there can be provided an ink jet recording apparatus capable of preventing drying of the discharge ports 111, 112 of the recording means 101 and the vicinity thereof even in the case of prolonged standing in the capped state, thereby enabling stable recovery operation of the recording means when the recording is re-started.

The present invention can attain similar effects on any ink jet recording apparatus utilizing at least a recording means employing pigment-based ink and at least a recording means employing dye-based ink. For example, a color recording apparatus utilizing plural recording means with inks of the same or different colors, a gradation recording apparatus utilizing plural recording means for recording with different densities of a same color, or a recording apparatus utilizing the combination of the foregoing may be used. Also, the present invention can attain similar effects in any configuration of the recording means and the ink tank. For example, a configuration employing a replaceable ink jet cartridge (recording head cartridge) integrally incorporating recording means and an ink tank, or a configuration in which the recording means and the ink tank are formed separately and are mutually connected by an ink supply tube may be used.

Furthermore, the present invention is applicable to an ink jet recording apparatus utilizing recording means employing an electromechanical converting member, such as a piezoelectric element, but brings about particularly excellent effects in an ink jet recording apparatus employing recording means utilizing thermal energy for ink discharge, because such system can attain higher density and higher definition in recording.

What is claimed is:

1. A head recovery device for an ink jet recording apparatus provided with a pigment discharge port for discharging pigment ink and a dye discharge port for discharging dye ink, comprising:

a pigment cap for capping said pigment discharge port and a dye cap for capping said dye discharge port, wherein, in a predetermined recovery operation, a preliminary discharge is executed from said dye discharge port to a contact portion of said pigment cap.

2. A head recovery device according to claim 1, wherein said pigment cap and said dye cap are respectively provided therein with an ink absorbing member.

3. A head recovery device according to claim 1, wherein said pigment discharge port is provided at a side closer than said dye discharge port to a recording area where recording is executed, and said pigment cap is provided at a side closer than said dye cap to the recording area.

4. A head recovery device according to claim 1, wherein said pigment cap and said dye cap are integrally constructed.

5. A head recovery device according to claim 1, further comprising a pigment pump for executing suction from said pigment discharge port when said pigment cap caps said pigment discharge port, and a dye pump for executing suction from said dye discharge port when said dye cap caps said dye discharge port.

6. A head recovery device according to claim 1, wherein, in the predetermined recovery operation, said dye discharge port is capped by said pigment cap and suction is executed from said dye discharge port.

7. An ink jet recording apparatus provided with a pigment discharge port for discharging pigment ink and a dye discharge port for discharging dye ink, comprising:

a pigment cap for capping said pigment discharge port and a dye cap for capping said dye discharge port, wherein, in a predetermined recovery operation, a preliminary discharge is executed from said dye discharge port to a contact portion of said pigment cap.

8. An ink jet recording apparatus according to claim 7, wherein said pigment cap and said dye cap are respectively provided therein with an ink absorbing member.

9. An ink jet recording apparatus according to claim 7, wherein said pigment discharge port is provided at a side closer than said dye discharge port to a recording area where recording is executed, and said pigment cap is provided at a side closer than said dye cap to the recording area.

10. An ink jet recording apparatus according to claim 7, wherein said pigment cap and said dye cap are integrally constructed.

11. An ink jet recording apparatus according to claim 7, further comprising a pigment pump for executing suction from said pigment discharge port when said pigment cap caps said pigment discharge port, and a dye pump for executing suction from said dye discharge port when said dye cap caps said dye discharge port.

12. An ink jet recording apparatus according to claim 7, wherein, in the predetermined recovery operation, said dye discharge port is capped by said pigment cap and suction is executed from said dye discharge port.

13. An ink jet recording apparatus according to claim 7, wherein the pigment ink comprises black ink, and the dye ink comprises color ink.

14. An ink jet recording apparatus according to claim 13, wherein the black ink comprises carbon black-based pigment ink.

15. An ink jet recording apparatus according to claim 14, wherein the carbon black-based pigment ink and the color dye ink are mutually non-reactive and do not show viscosity increase, precipitation or solidification when they are mutually mixed.

16. An ink jet recording apparatus according to claim 14, wherein the carbon black-based pigment ink and the color dye ink are mutually reactive and show viscosity increase, precipitation or solidification by an anionic reaction, a cationic reaction or an ionic coupling reaction when they are mutually mixed.

17. An ink jet recording apparatus according to claim 13, wherein the color ink comprises color inks of cyan, magenta and yellow colors.

18. An ink jet recording apparatus according to claim 13, wherein the color ink comprises color inks of cyan, magenta, yellow, pale cyan, pale magenta and pale yellow colors.

19. An ink jet recording apparatus according to claim 7, wherein said pigment discharge port is provided in a pigment discharge head having an energy generating member for generating energy to be utilized for discharging the pigment ink from said pigment discharge port.

20. An ink jet recording apparatus according to claim 19, wherein said energy generating member comprises an electrothermal converting element for generating thermal energy.

21. An ink jet recording apparatus according to claim 7, wherein said dye discharge port is provided in a dye discharge head having an energy generating member for generating energy to be utilized for discharging the dye ink from said dye discharge port.

22. An ink jet recording apparatus according to claim 21, wherein said energy generating member comprises an electrothermal converting element for generating thermal energy.

23. A head recovery method for an ink jet recording apparatus provided with a pigment discharge port for discharging pigment ink and a dye discharge port for discharging dye ink, comprising:

a step of executing a preliminary discharge, which does not contribute to recording, from the pigment discharge port to a pigment cap;

a step of executing a preliminary discharge from the dye discharge port to a dye cap; and a step of executing a preliminary discharge from the dye discharge port to a contact portion of the pigment cap.

24. A head recovery method according to claim 23, further comprising, after the step of executing a preliminary discharge from the dye discharge port to the pigment cap, a step of capping the pigment discharge port with the pigment cap.

* * * * *

UNITED STATES PATENT AND TRADEMARK OFFICE

CERTIFICATE OF CORRECTION

PATENT NO. : 6,913,339 B2
APPLICATION NO. : 09/968792
DATED : July 5, 2005
INVENTOR(S) : Uchida et al.

It is certified that error appears in the above-identified patent and that said Letters Patent is hereby corrected as shown below:

COLUMN 3
Line 57, "Interior" should read -- interior--.

COLUMN 11
Line 30, "apply" should be deleted.

COLUMN 18
Line 31, "jet" should read --let--.
Line 63, "following there,"should read --following, there--.

COLUMN 21
Line 24, "Ink" should read --ink--.

Signed and Sealed this

Fifth Day of September, 2006

JON W. DUDAS
*Director of the United States Patent and Trademark Office*